US006948290B2

(12) United States Patent
Ritz

(10) Patent No.: US 6,948,290 B2
(45) Date of Patent: Sep. 27, 2005

(54) SYSTEM AND METHOD FOR INCREASING THE LOAD CAPACITY AND STABILITY OF GUYED TOWERS

(75) Inventor: Charles D. Ritz, Norcross, GA (US)

(73) Assignee: Ritz Telecommunications, Inc., Norcross, GA (US)

( * ) Notice: Subject to any disclaimer, the term of this patent is extended or adjusted under 35 U.S.C. 154(b) by 286 days.

(21) Appl. No.: 09/736,828

(22) Filed: Dec. 13, 2000

(65) Prior Publication Data

US 2001/0000839 A1 May 10, 2001

(51) Int. Cl.[7] ..... E04H 12/10

(52) U.S. Cl. ..... 52/651.02; 52/736.1; 52/146; 52/148; 52/40; 52/651.01; 52/651.04; 52/726.1; 52/726.3; 52/223.4; 343/878; 343/890

(58) Field of Search ..... 52/736.1, 146, 52/148, 40, 651.01, 726.1, 726.3, 651.02, 223.4, 651.04; 343/878, 890

(56) References Cited

U.S. PATENT DOCUMENTS

| | | | | | |
|---|---|---|---|---|---|
| 3,303,506 | A | | 2/1967 | Diebold | |
| 4,216,636 | A | | 8/1980 | Cordell | |
| 4,295,317 | A | | 10/1981 | VanTielen | |
| 4,334,775 | A | * | 6/1982 | Breecher et al. | 356/152 |
| 4,363,568 | A | * | 12/1982 | Schuh | 405/227 |
| RE32,119 | E | * | 4/1986 | Abbott et al. | 405/227 |
| 4,599,014 | A | | 7/1986 | McGillivray et al. | |
| 4,610,569 | A | | 9/1986 | Finn et al. | |
| 4,687,380 | A | | 8/1987 | Meek et al. | |
| 4,696,603 | A | * | 9/1987 | Danaczko et al. | 405/227 |
| 4,704,051 | A | * | 11/1987 | Ellingvag | 405/224 |
| 4,745,412 | A | | 5/1988 | Creaser, Jr. | |
| 4,987,718 | A | | 1/1991 | Knight | |
| 4,991,367 | A | | 2/1991 | McGinnis | |
| 5,097,647 | A | | 3/1992 | Sopik et al. | |
| 5,117,607 | A | | 6/1992 | Bourdon | |
| 5,237,783 | A | | 8/1993 | DiRico et al. | |
| 5,333,436 | A | | 8/1994 | Noble | |
| 5,333,824 | A | | 8/1994 | Dubinsky | |
| 5,345,732 | A | | 9/1994 | Knight et al. | |
| 5,371,986 | A | | 12/1994 | Guditis | |
| 5,649,402 | A | | 7/1997 | Moore | |
| 5,687,537 | A | | 11/1997 | Noble | |
| 5,832,688 | A | * | 11/1998 | Crissey et al. | 52/651.01 |
| 5,855,103 | A | | 1/1999 | Moore | |
| 6,026,627 | A | | 2/2000 | Moore | |
| 6,028,566 | A | * | 2/2000 | Pennell et al. | 343/878 |
| 6,142,434 | A | | 11/2000 | Trost et al. | |
| 6,343,445 | B1 | * | 2/2002 | Ryan | 52/148 |
| 6,351,250 | B1 | * | 2/2002 | Gillen | 343/890 |
| 6,453,636 | B1 | * | 9/2002 | Ritz | 52/736.4 |
| 6,668,498 | B2 | * | 12/2003 | Ritz | 52/148 |

* cited by examiner

*Primary Examiner*—Carl D. Friedman
*Assistant Examiner*—Christy Green
(74) *Attorney, Agent, or Firm*—Thomas, Kayden, Horstemeyer & Risley, L.L.P.

(57) ABSTRACT

A guyed tower is used to support wireless communication equipment and/or other types of loads. The guyed tower is fixedly attached to a foundation, and a pole tower is erected within a middle region of the guyed tower. This pole tower is also fixedly attached to the foundation. The pole tower supports the guyed tower by absorbing bending moments that are applied to the guyed tower. Thus, the presence of the pole tower within the middle region of the guyed tower enables the guyed tower to support additional wireless transmission equipment and/or other types of loads.

15 Claims, 26 Drawing Sheets

(Top View)

SYSTEM AND METHOD FOR INCREASING THE LOAD CAPACITY AND STABILITY OF GUYED TOWERS

BACKGROUND OF THE INVENTION

1. Field of the Invention

The present invention generally relates to techniques for supporting wireless communication equipment and, in particular, to a system and method for increasing the load capacity and stability of a guyed tower, thereby enabling the guyed tower to support heavier or additional wireless communication equipment and/or other types of loads.

2. Related Art

The increase in wireless telecommunications traffic has resulted in a concomitant increase in the need for guyed mounted transmission equipment of all kinds. Not only do wireless service providers need to install equipment covering new geographic areas, competing services providers and others also need to install additional equipment covering the same or similar geographic areas. To date, the solution to the foregoing problems normally includes purchasing additional land or easements, applying for the necessary government permits and zoning clearances, and constructing a new guyed tower for new transmission equipment.

Purchasing land or easements, however, is becoming increasingly expensive, particularly in urban areas where the need for wireless telecommunications is greatest. Zoning regulations often limit the construction of new guyed towers in the most suitable locations. The expense and delay associated with the zoning process often are cost-prohibitive or so time consuming that construction of the new tower is not feasible. Even when zoning regulations can be satisfied and permits can be obtained, the service provider must then bear the burden and expense associated with the construction and the maintenance of the tower.

The guyed tower itself should be designed to support the weight of the telecommunications transmission equipment as well as the forces exerted on the guyed tower by environmental factors, such as wind and ice, for example. The equipment and the environmental factors produce forces known as bending moments that, in effect, may cause a single guyed tower to collapse if the tower is not designed for adequate stability. Traditionally, single guyed towers have been designed to withstand the forces expected from the equipment originally installed on the guyed tower. Very few single guyed towers are designed with sufficient stability to allow for the addition of new equipment.

Thus, there is a need for a method and a system for increasing the load capacity and stability of a single guyed tower to enable the guyed tower to support the weight of additional equipment as well as the environmental forces exerted on the guyed tower.

SUMMARY OF THE INVENTION

The present invention overcomes the inadequacies and deficiencies of the prior art as discussed hereinbefore. Generally, the present invention provides a system and method for increasing the load capacity and stability of a guyed tower so that the guyed tower can better support wireless communication equipment and/or other types of loads.

In accordance with the present invention, wireless transmission equipment and/or other types of loads are secured to a guyed tower that is fixedly attached to a foundation. A pole tower is erected within a middle region of the guyed tower. This pole tower is fixedly attached to the foundation and absorbs bending moments that are applied to the guyed tower. Thus, the presence of the pole tower within the middle region of the guyed tower increases the load capacity and stability of the guyed tower.

The present invention can also be viewed as providing a method for increasing a load capacity of a guyed tower. The method can be broadly conceptualized by the following steps: erecting a pole tower within a middle region of the guyed tower; and fixedly attaching the pole tower to the foundation.

Other features and advantages of the present invention will become apparent to one skilled in the art upon examination of the following detailed description, when read in conjunction with the accompanying drawings. It is intended that all such features and advantages be included herein within the scope of the present invention and protected by the claims.

BRIEF DESCRIPTION OF THE DRAWINGS

The invention can be better understood with reference to the following drawings. The elements of the drawings are not necessarily to scale relative to each other, emphasis instead being placed upon clearly illustrating the principles of the invention. Furthermore, like reference numerals designate corresponding parts throughout the several views.

DETAILED DESCRIPTION OF THE PREFERRED EMBODIMENT

In general, the present invention pertains to a system and method for supporting wireless communication equipment and/or other types of loads. In this regard, a pole tower of suitable strength is positioned within the middle region of a guyed tower and attached to the foundation of the guyed tower. In a preferred embodiment, the pole tower is attached to the guyed tower at various locations to maximize the strength and reinforcement provided by the pole tower. The presence of the pole tower within the middle region of the guyed tower reinforces the strength and stability of the guyed tower, thereby enabling the guyed tower to support additional weight. Thus, the guyed tower is able to support additional wireless communication equipment and/or other types of loads.

Figure 1:
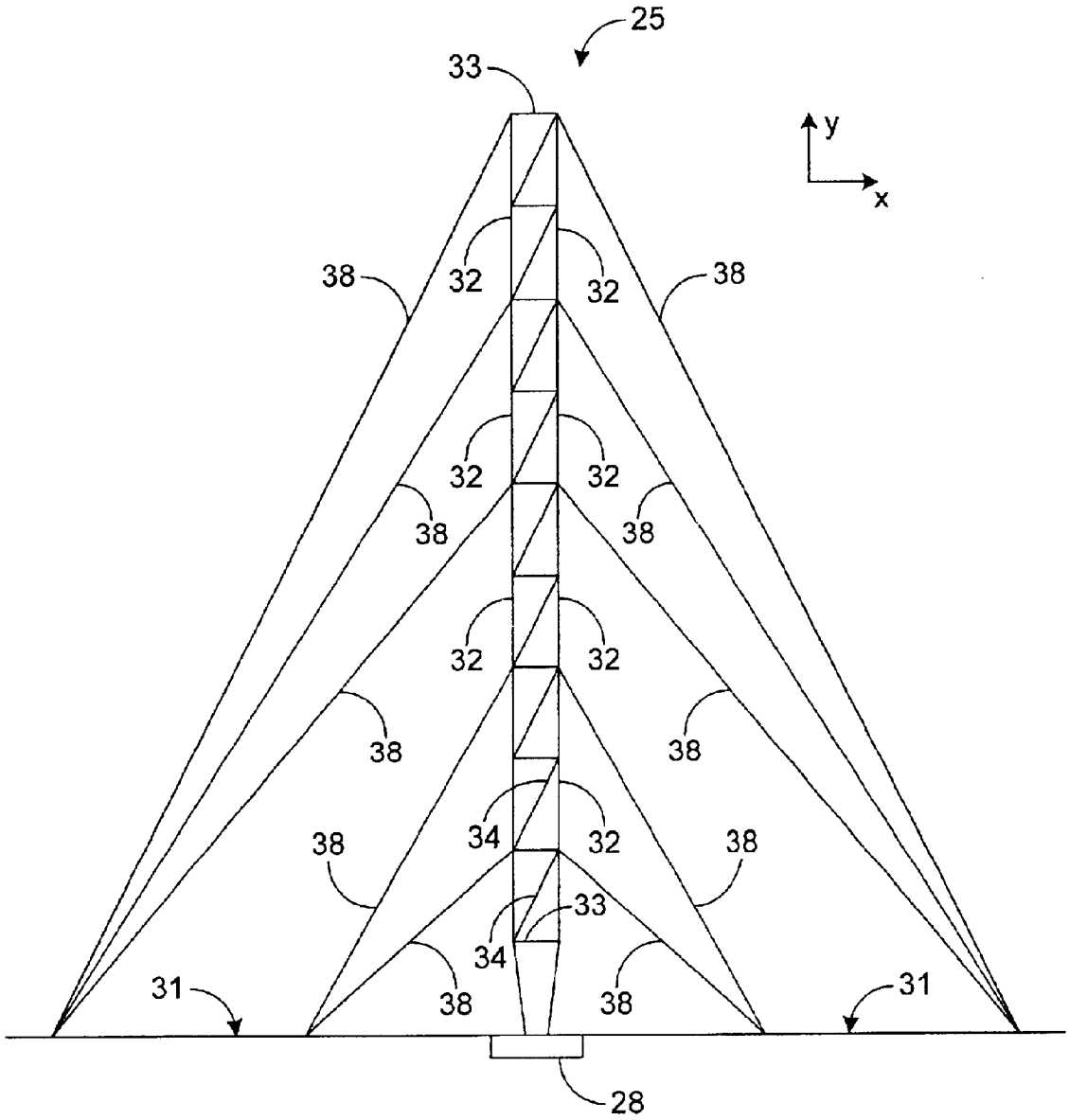
FIG. 1 (Prior Art)
FIG. 1 is a diagram illustrating a conventional guyed tower that is supported by various guy wires extending from the guyed tower to the ground.

FIG. 1 depicts a guyed tower 25 in accordance with the prior art. As can be seen by referring to FIG. 1, the guyed tower 25 is attached to a foundation 28, which is usually a block of cement residing on or within the Earth's surface 31. The guyed tower 25 is comprised of various interconnected beams. More specifically, the guyed tower 25 of FIG. 1 is comprised of vertical beams 32 (substantially parallel to the y-direction), horizontal beams 33 (substantially parallel to the x-direction), and diagonal beams 34. The beams 32–34 are interconnected together to form a structure capable of supporting various equipment (not shown), such as wireless communication equipment, that may be attached to one or more of the beams 32–34. The guyed tower 25 normally extends away from the foundation 28 in an upward direction (i.e., y-direction), as shown by FIG. 1. To provide the guyed tower 25 with adequate stability, guy wires 38 are attached to the tower 25 at various locations and extend from the tower 25 to the Earth's surface 31, as shown by FIG. 1. The number and placement of the guy wires 38 may vary for different guyed towers 25.

Figure 2:
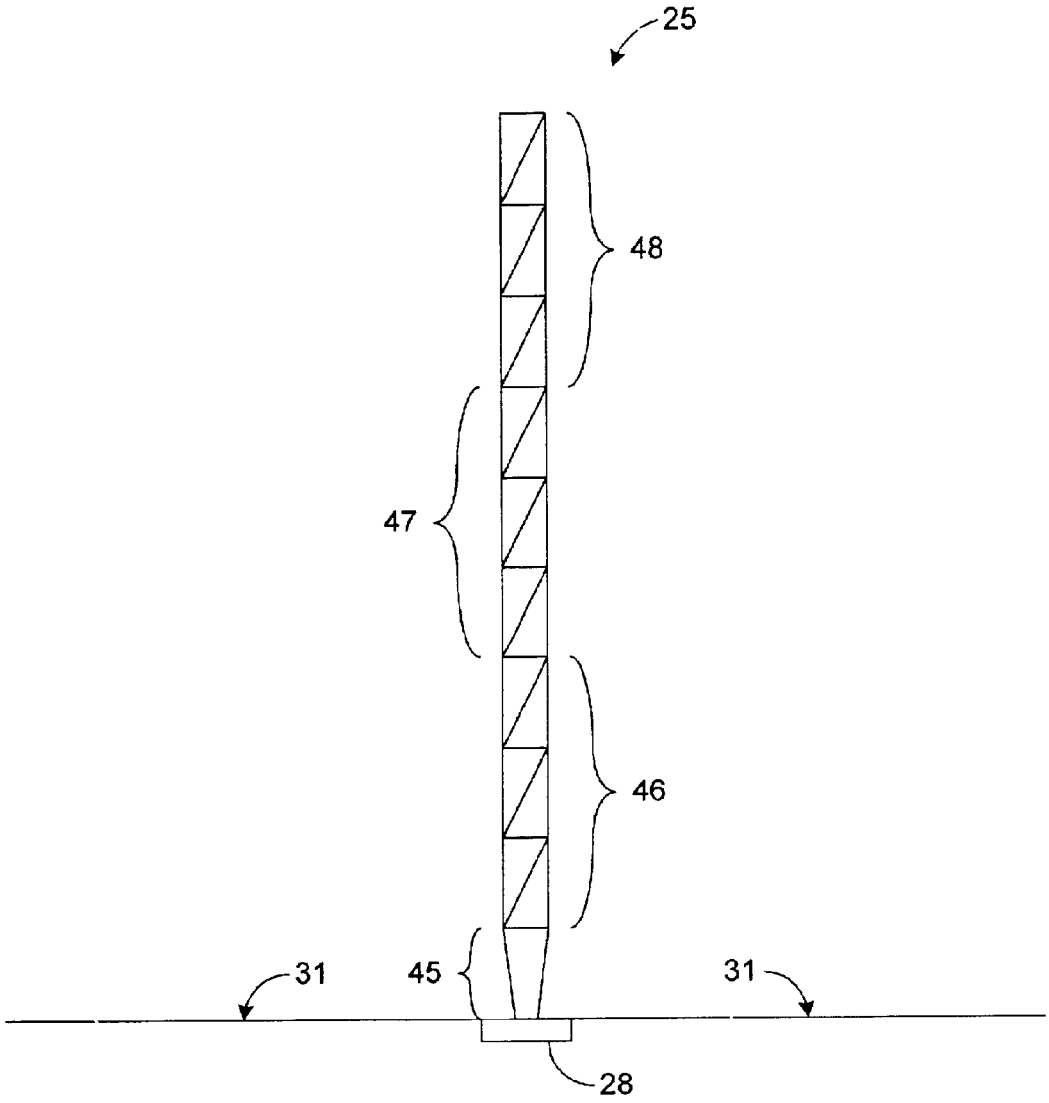
FIG. 2 (Prior Art)
FIG. 2 is a diagram illustrating the guyed tower of FIG. 1 with the guy wires removed for illustrative purposes.

Normally, the guyed tower 25 is erected in sections. For example, as shown by FIG. 2, the guyed tower 25 in one embodiment includes four different sections: a bottom section 45, two middle sections 46 and 47, and a top section 48. In FIG. 2, the bottom section 45 is tapered such that the perimeter at the foundation 28 is smaller than the perimeter of the section 45 on a side opposite of the foundation 28. Furthermore, in FIG. 2, the configurations of sections 46–48 are identical. However, it should be noted that it is not necessary for the configuration of bottom section 45 to be different than the configurations of the sections 46–48, and it is possible for each of the sections 45–48 to be similarly or differently configured.

In constructing the tower 25, the foundation 28 is poured, and the bottom section 45 is attached to the foundation 28. Then, section 46 is attached to bottom section 45, and sections 47 and 48 are consecutively attached to sections 46 and 47, respectively. The guy wires 38 can be attached to any of the sections 45–48 as the guyed tower 25 is being erected.

Figure 3:
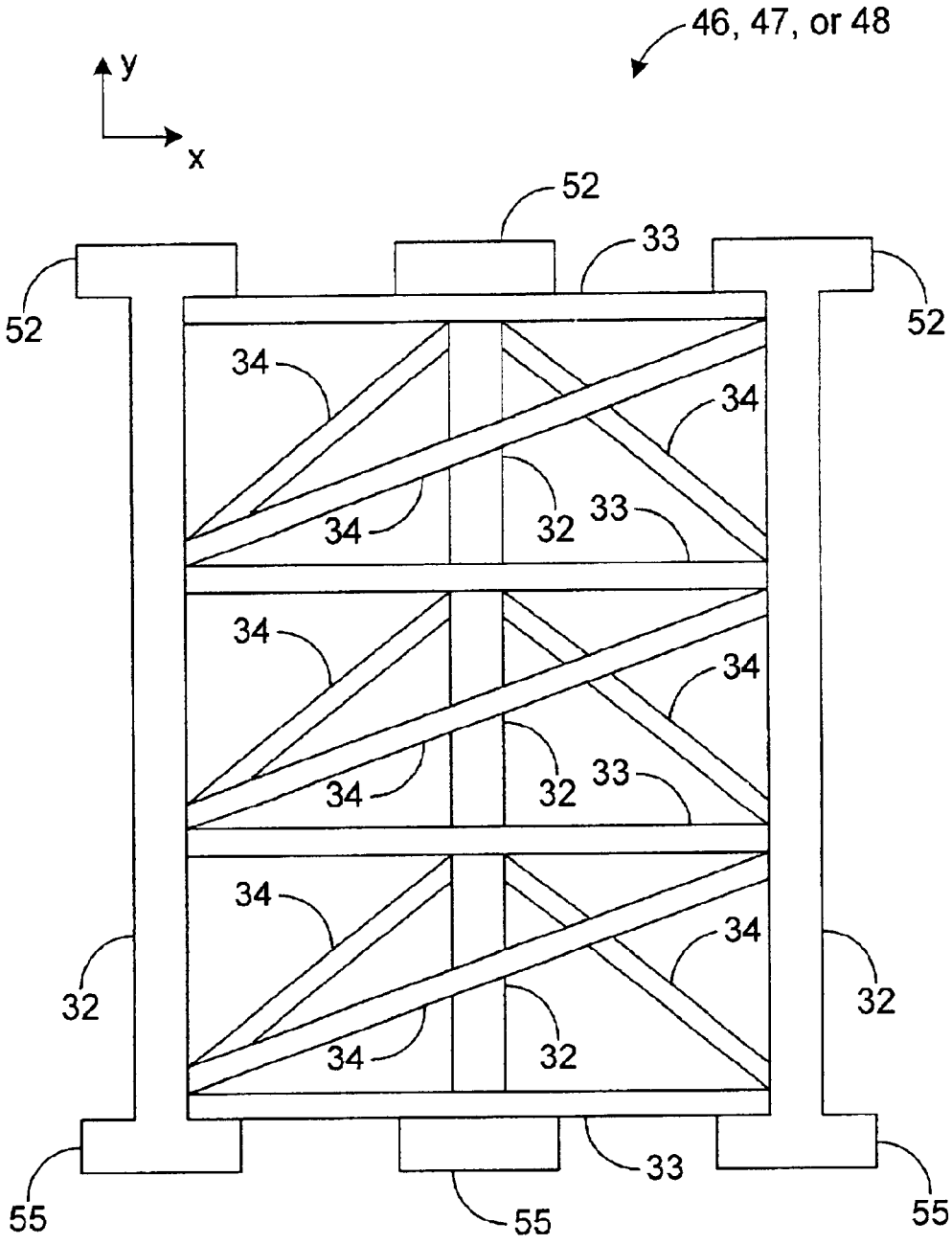
FIG. 3 (Prior Art)
FIG. 3 is a diagram illustrating a more detailed view of a single section of the conventional guyed tower depicted in FIG. 1.
Figure 4:
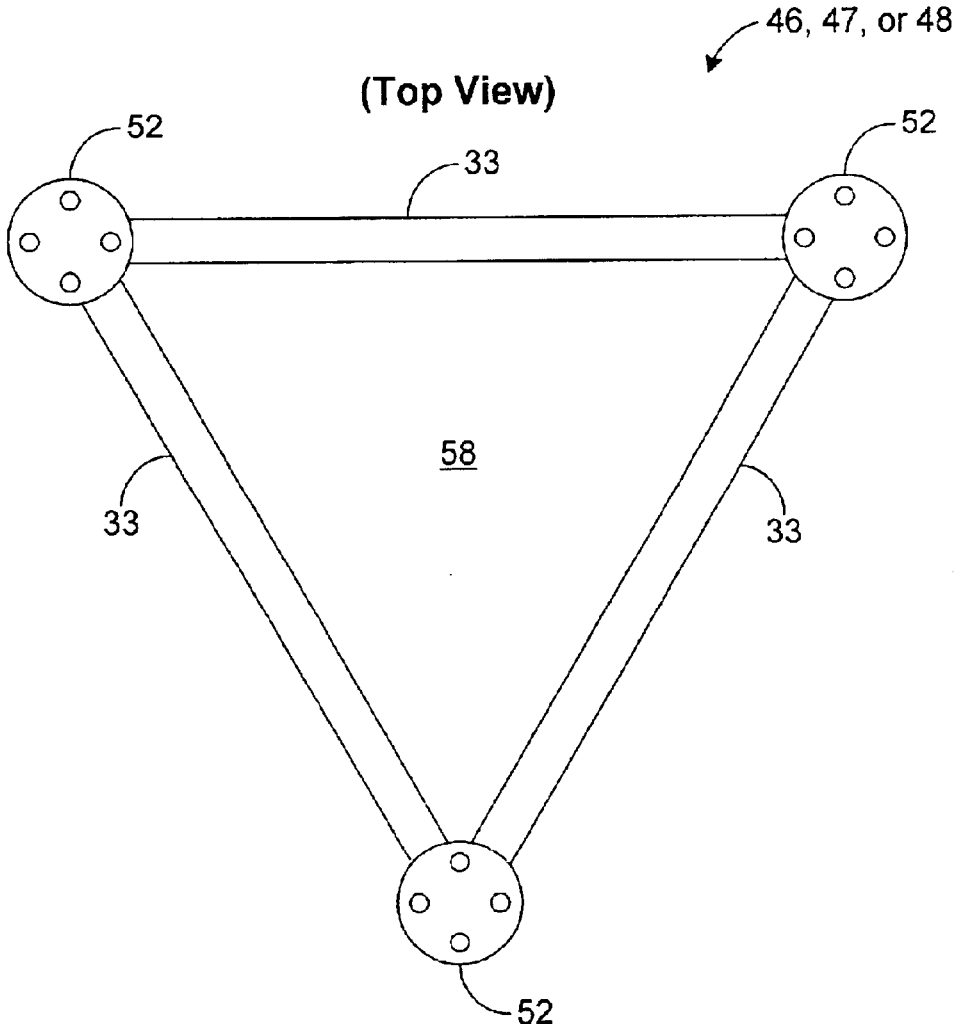
FIG. 4 (Prior Art)
FIG. 4 is a top view of the single guyed tower section depicted by FIG. 3.
Figure 5:
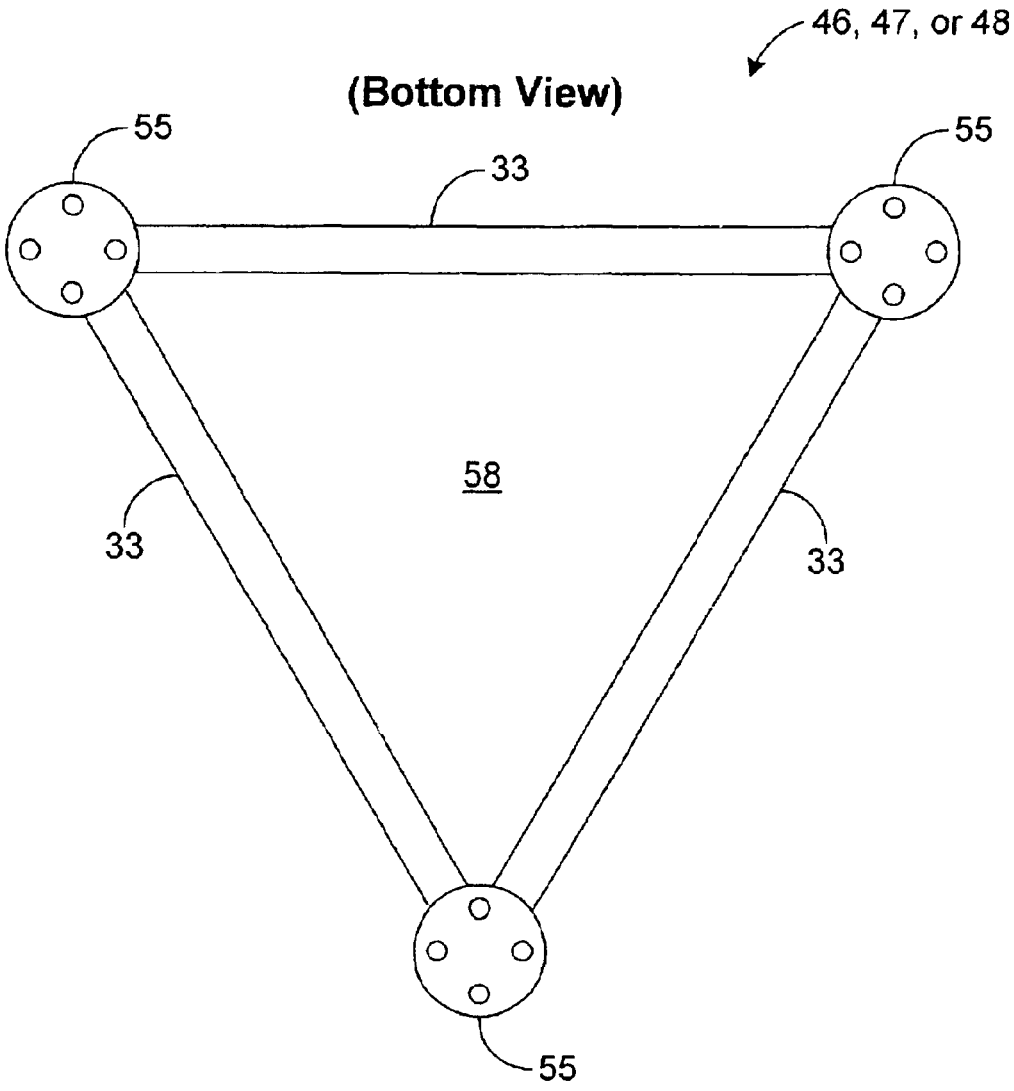
FIG. 5 (Prior Art)
FIG. 5 is a bottom view of the single guyed tower section depicted by FIG. 3.

FIG. 3 depicts a more detailed view of any one of the middle or top sections 46–48. As shown by FIG. 3, each of the sections 46–48 includes a plurality of interconnected beams 32–34 that form a truss. The configuration and geometry of the beams 32–34 may vary for different guyed towers 25. However, each section 45–48 of most conventional guyed towers 25 includes either three or four vertical beams 32 that are interconnected via horizontal and/or diagonal beams 33 and 34, as shown by FIG. 3. A top end of each vertical beam 32 normally forms a top flange 52, and the bottom end of each vertical beam 32 normally forms a bottom flange 55. As shown by FIGS. 4 and 5, a middle region 58 that is defined by the perimeter formed by beams 32–34 is empty such that an object can pass through the middle region 58 of each section 46–48 in a direction parallel to the y-direction.

Figure 6:
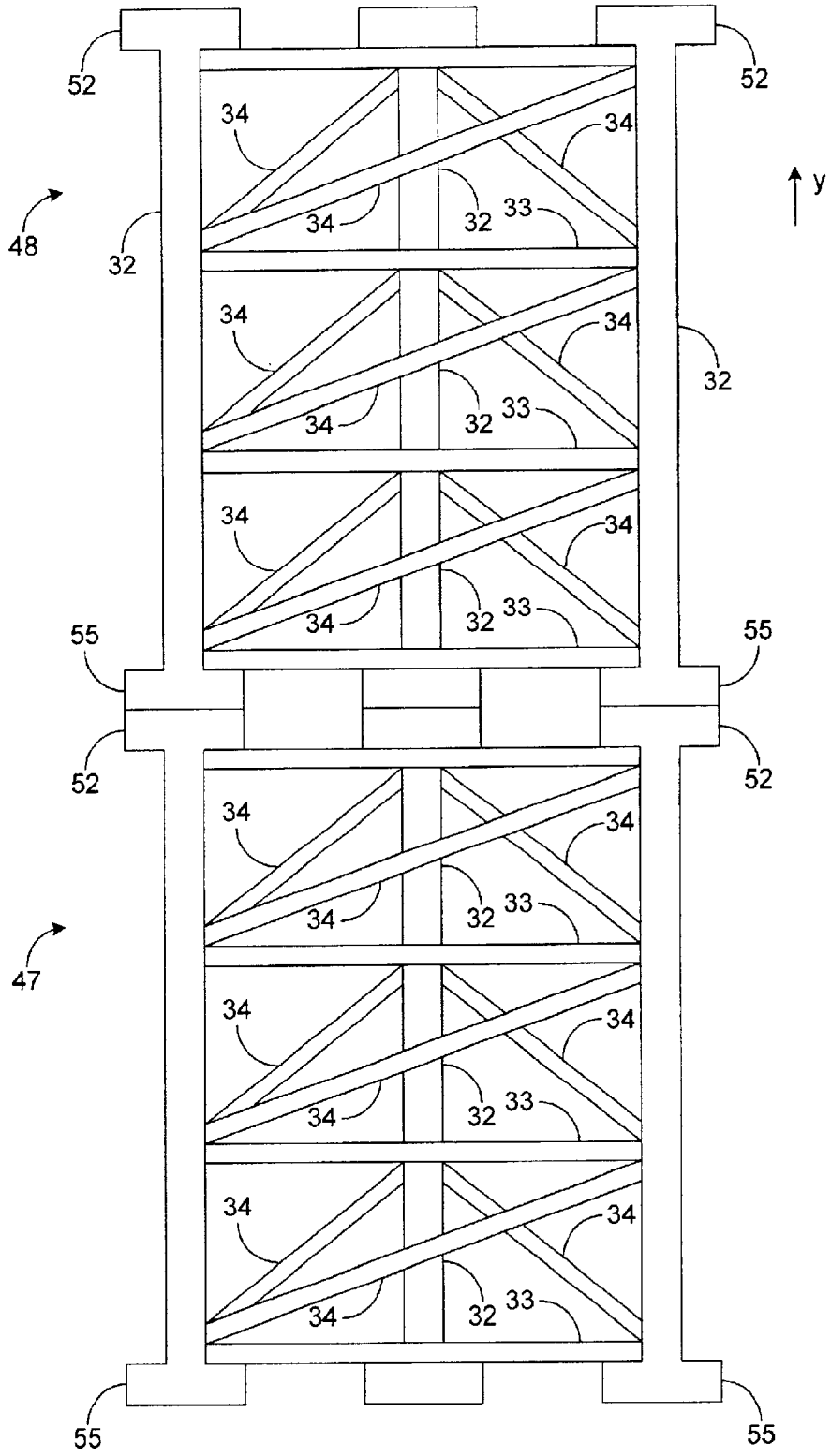
FIG. 6 (Prior Art)
FIG. 6 is a diagram illustrating two joined sections of the conventional guyed tower depicted by FIG. 1.

As previously set forth, the tower 25 is erected by attaching sections 45–48 to one another until the resulting tower 25 shown by FIG. 1 is formed. FIG. 6 depicts a more detailed view of section 48 attached to section 47. In attaching section 47 to section 48, the bottom flanges 55 of section 48 are fixedly attached to the top flanges 52 of section 47. The flanges 52 and 55 may be fixedly attached via any suitable technique. Often, one or more couplers (such as bolts, nails, screws, etc.) are inserted through holes in each set of attached flanges 52 and 55 in order to secure the bottom flanges 55 of section 48 to the top flanges 52 of section 47. Similar techniques may be employed to fixedly attach section 46 to 47. Furthermore, the bottom section 45 may include top flanges that may be fixedly attached to the bottom flanges 55 of section 46 in order to fixedly attach bottom section 45 to section 46. Thus, by attaching the sections 45–48 to one another as described above, the guyed tower 25 may be erected.

Figure 7:
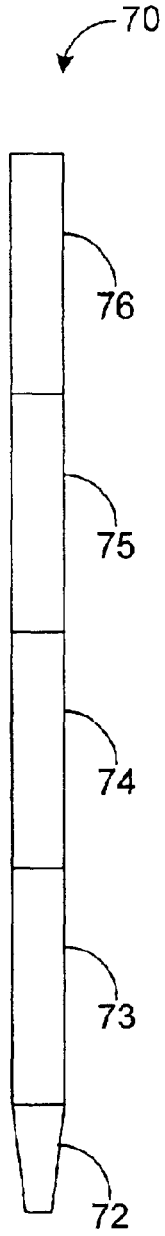
FIG. 7 is a diagram illustrating an exemplary embodiment for a pole tower in accordance with the present invention.

FIG. 7 depicts a pole tower 70 that may be erected through the middle of the guyed tower 25 to provide the guyed tower 25 with increased strength and stability. Various configurations of the pole tower 70 are possible. To facilitate the erection of the pole tower 70, the pole tower 70 of FIG. 7 preferably includes multiple sections 72–76. Bottom section 72 is tapered so that it can fit within the bottom section 45 of guyed tower 25. However, in embodiments where the bottom section 45 of guyed tower 25 is not tapered, it is not necessary for the bottom section 72 of pole tower 70 to be tapered. Indeed, different configurations of the sections 72–76 are possible provided that the sections 72–76 are capable of fitting through the middle of the guyed tower 25. Furthermore, in the embodiment shown by FIG. 7, each of the other sections 73–76 is identically configured, although identical configurations of each of the sections 73–76 is not a necessary feature of the present invention.

Figure 8:
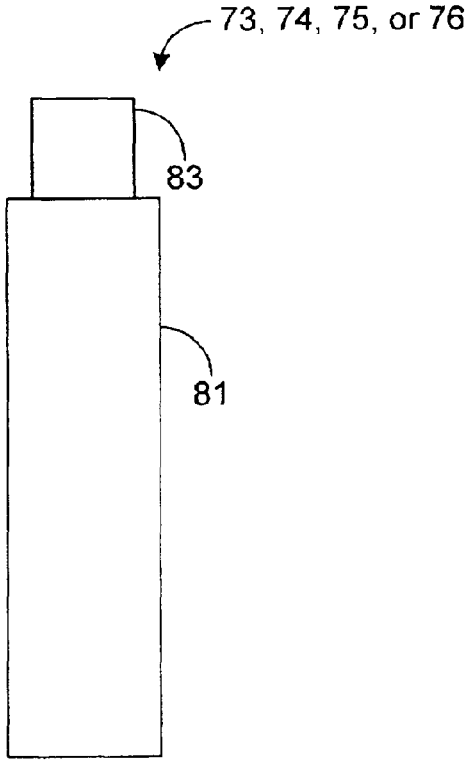
FIG. 8 is a diagram illustrating a more detailed view of a single section of the pole tower depicted in FIG. 7.

FIGS. 8–11 depict exemplary configurations for the sections 73–76. In this regard, FIG. 8 depicts an exemplary configuration of one of the sections 73–76. As can be seen by referring to FIG. 8, the section 73–76 includes a main body portion 81 and a top portion 83. The main body portion 81 is hollow and adapted to receive the top portion 83 of another section 73–76. Therefore, each of the sections 73–76 can be stacked on top of one another with the top portion 83 of each section 73–76 extending into the hollow region of the main body portion 81 of another section 73–76.

Figure 9:
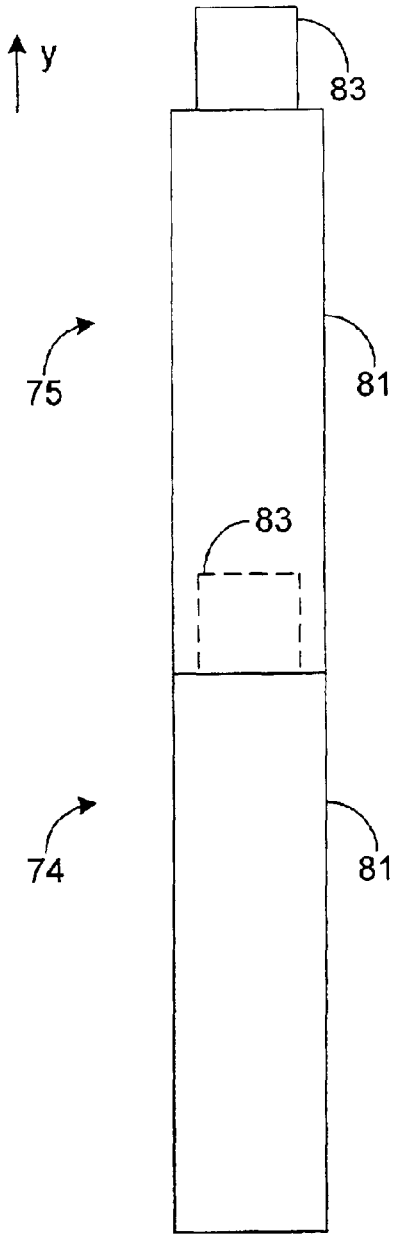
FIG. 9 is a diagram illustrating two joined sections of the pole tower depicted in FIG. 7.

As an example, FIG. 9 depicts one of the sections 75 erected onto another of the sections 74. As shown by FIG. 9, the main body portion 81 of section 75 rests on the main body portion 81 of section 74. Furthermore, the top portion 83 of section 74 extends into the hollow region of the main body portion 81 of section 75. The inner wall of section 75 preferably is in contact with the top portion 83 of section 74 such that the section 75 is secured to the section 74. More particularly, the main body portion 81 of section 74 resists the gravitational force applied to section 75, and the top portion 83 of section 74 resists any force applied to section 75 that would tend to cause the section 75 to rotate.

By stacking each of the sections 73–76 on one another as shown by FIG. 9, the pole tower 70 can be erected according to FIG. 7. It should be noted that bottom section 72 may include a top portion similar to the top portion 83 shown in FIGS. 8 and 9. Therefore, similar to the sections 74 and 75 shown in FIG. 9, section 73 may be erected onto bottom section 72 with the top portion of section 72 extending into the hollow region of section 74, thereby securing bottom section 72 to section 73.

Figure 10:
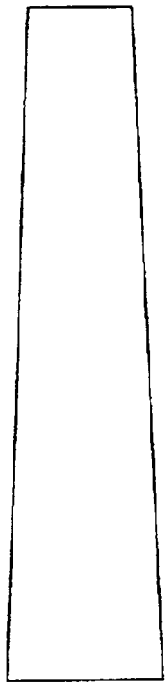
FIG. 10 is a diagram illustrating another embodiment for the single section of the pole tower depicted in FIG. 8.
Figure 11:
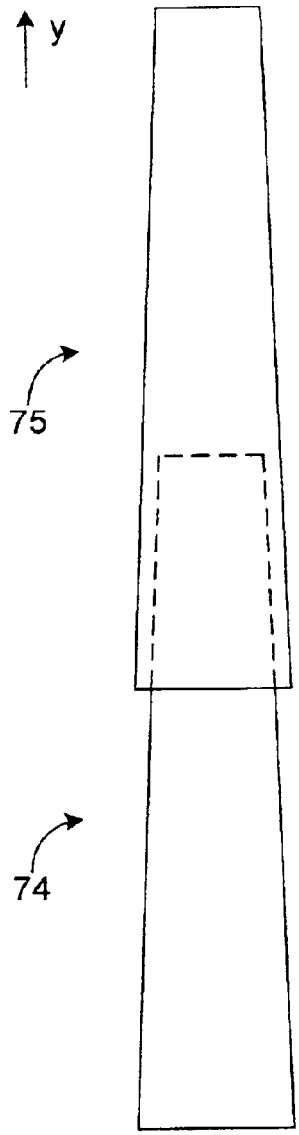
FIG. 11 is a diagram illustrating another embodiment for the two joined sections depicted in FIG. 9.

FIGS. 10 and 11 depict another embodiment for the configuration of section 73–76. In this regard, each section 73–76 is a tapered hollow pipe, and FIG. 11 depicts how one of the sections 75 may be erected onto another of the sections 74. More specifically, the top portion of section 74 may be inserted in to the hollow region of section 75 until the inner wall of section 75 engages the outer wall of section 74. Once this occurs, the section 75 should be secured to the section 74 via gravity. Thus, by stacking each of the sections 73–76 on top of one another in this way, the pole tower 70 can be erected. Furthermore, the top portion of section 72 may be tapered similar to the sections 73–76 such that the top portion of section 72 may fit into the hollow region of section 73.

There are various other methodologies that may be employed to erect the pole tower 70 without departing from the principles of the present invention. In this regard, any methodology for erecting and configuring the pole tower 70 should be sufficient for the purposes of the present invention provided that the pole tower 70 is capable of fitting within the middle of the guyed tower 25. Furthermore, it is not necessary for the pole tower 70 to be a hollow or sectional structure. In this regard, the pole tower 70 may be solid, such as a solid pipe, for example. However, it may be preferable for the pole tower 70 to be hollow and/or sectional, as described hereinabove, in order to enable the pole tower 70 to be erected as previously described and/or to reduce the overall weight of the pole tower 70, thereby making it easier to erect the pole tower 70 within the guyed tower 25.

Figure 12:
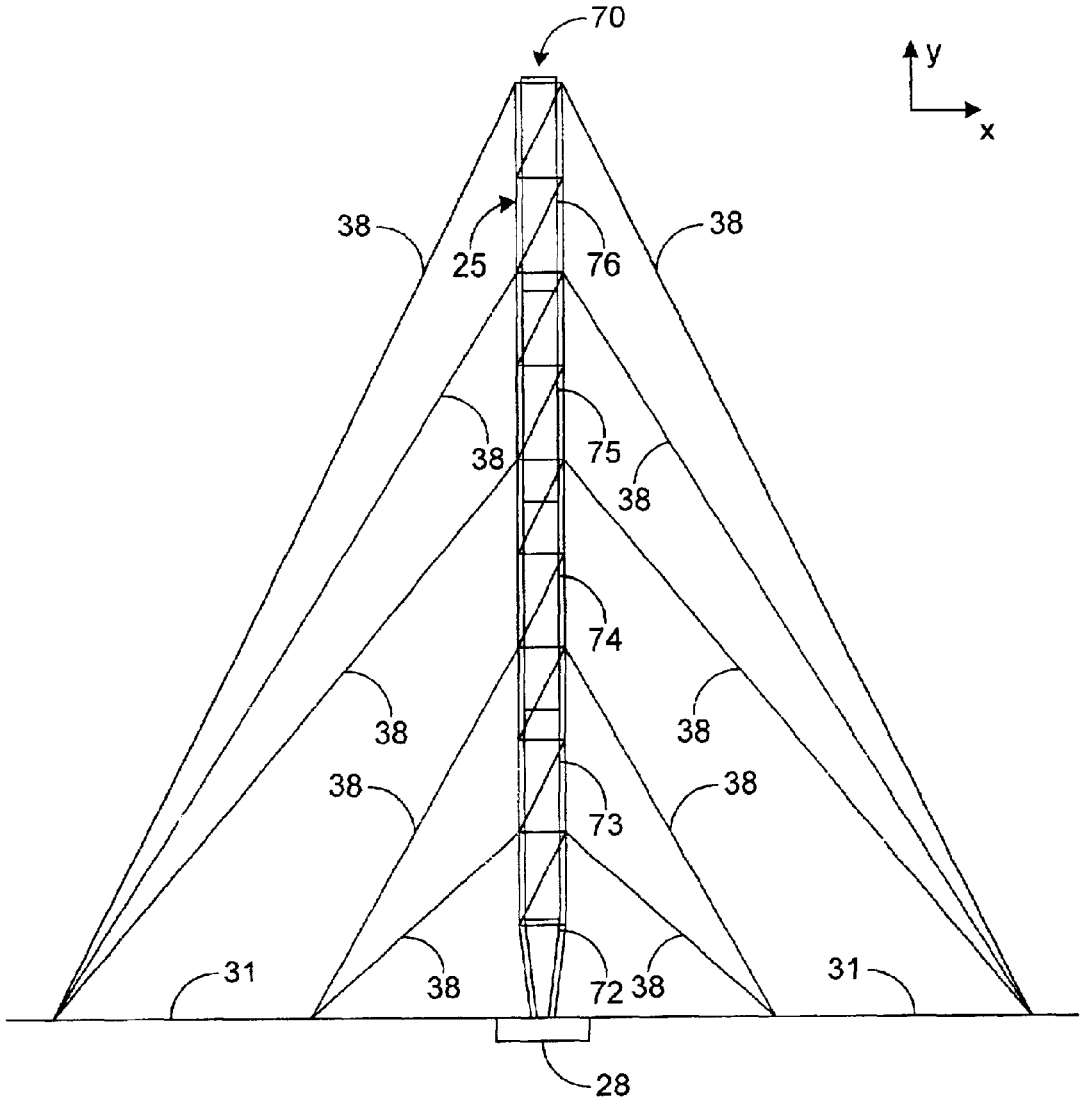
FIG. 12 is a diagram illustrating the pole tower of FIG. 7 erected within the guyed tower of FIG. 1.

FIG. 12 depicts the guyed tower 25 of FIG. 1 once the pole tower 70 of FIG. 7 has been erected within the guyed tower 25. As shown by FIG. 12, the bottom section 72 of the pole tower 70 is fixedly attached to the foundation 28, and the remainder of the sections 73–76 are consecutively stacked on top of the bottom section 72. Thus, the pole tower 70 extends from the foundation 28 up through the middle of the guide tower 25. Although the pole tower 70 may be shorter than the guyed tower 25, the pole tower 70 in the preferred embodiment extends from the foundation 28 through the top of the guyed tower 25 as shown by FIG. 12. Generally, the higher the pole tower 70 is extended through the guyed tower 25, the better the pole tower 70 supports and stabilizes the guyed tower 25.

Figure 13:
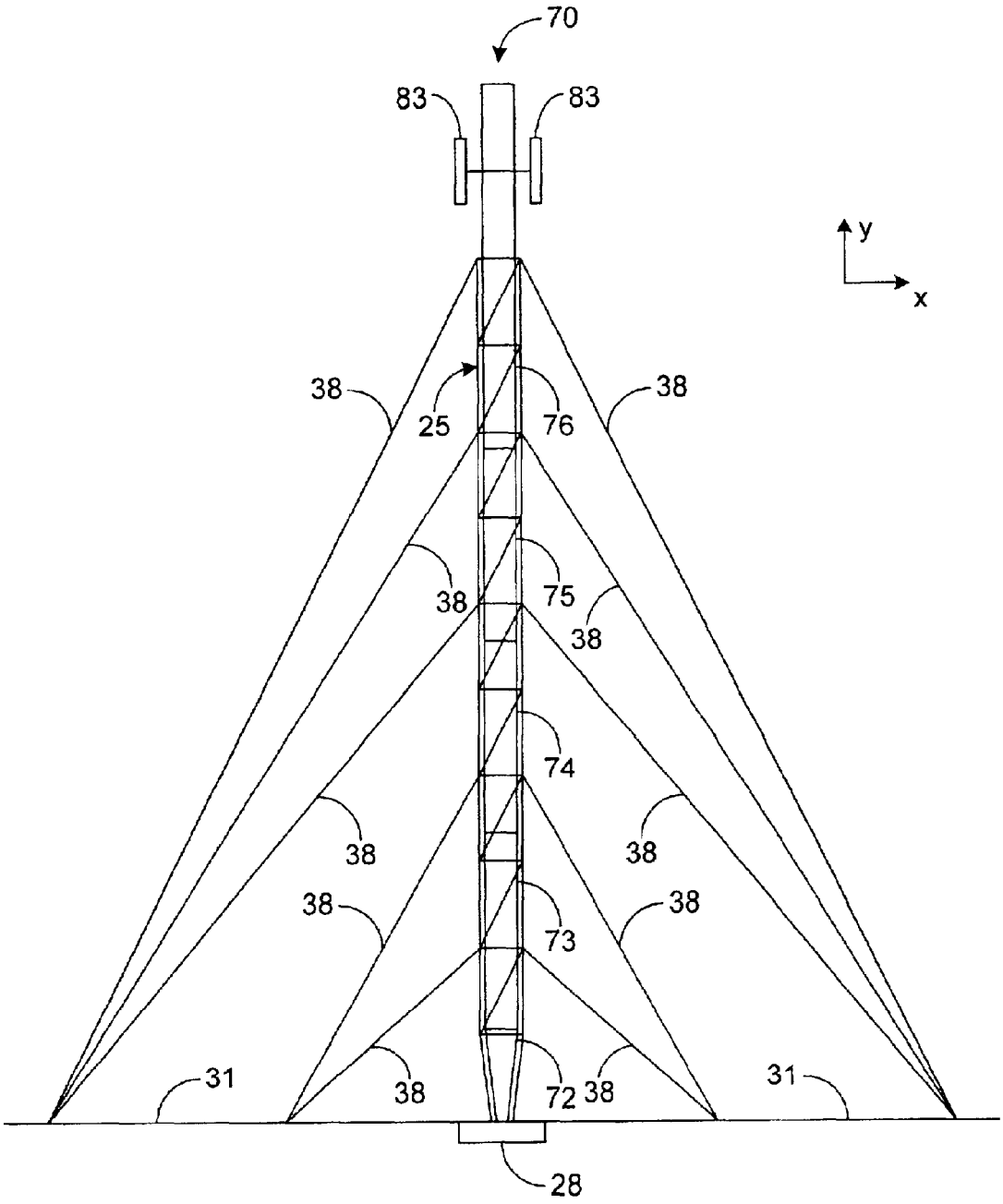
FIG. 13 is a diagram illustrating the pole tower of FIG. 7 when communication equipment is attached to a top of the pole tower.

Furthermore, it is possible to attach wireless communication equipment and/or other types of loads directly to the pole tower 70. Such loads may be coupled to the pole tower 70 at any point along the vertical length (i.e., the length in the y-direction) of the pole tower 70. If desired, the top of the pole tower 70 may extend past the top of the guyed tower 25, and the wireless communication equipment and/or other types of loads may be attached the pole tower 70 above the top of the guyed tower 25, as shown by FIG. 13.

Figure 14:
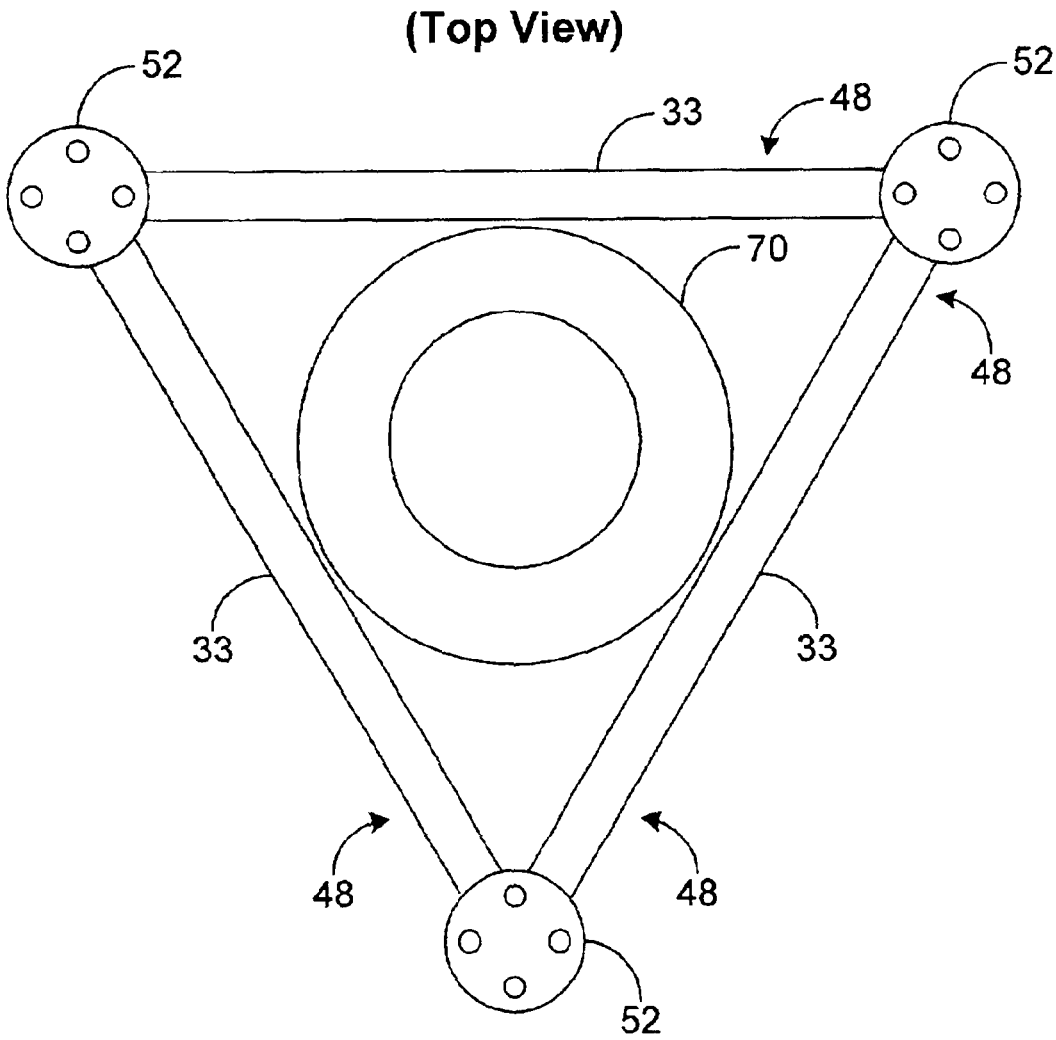
FIG. 14 is a diagram illustrating a top view of the towers depicted in FIG. 12.
Figure 15:
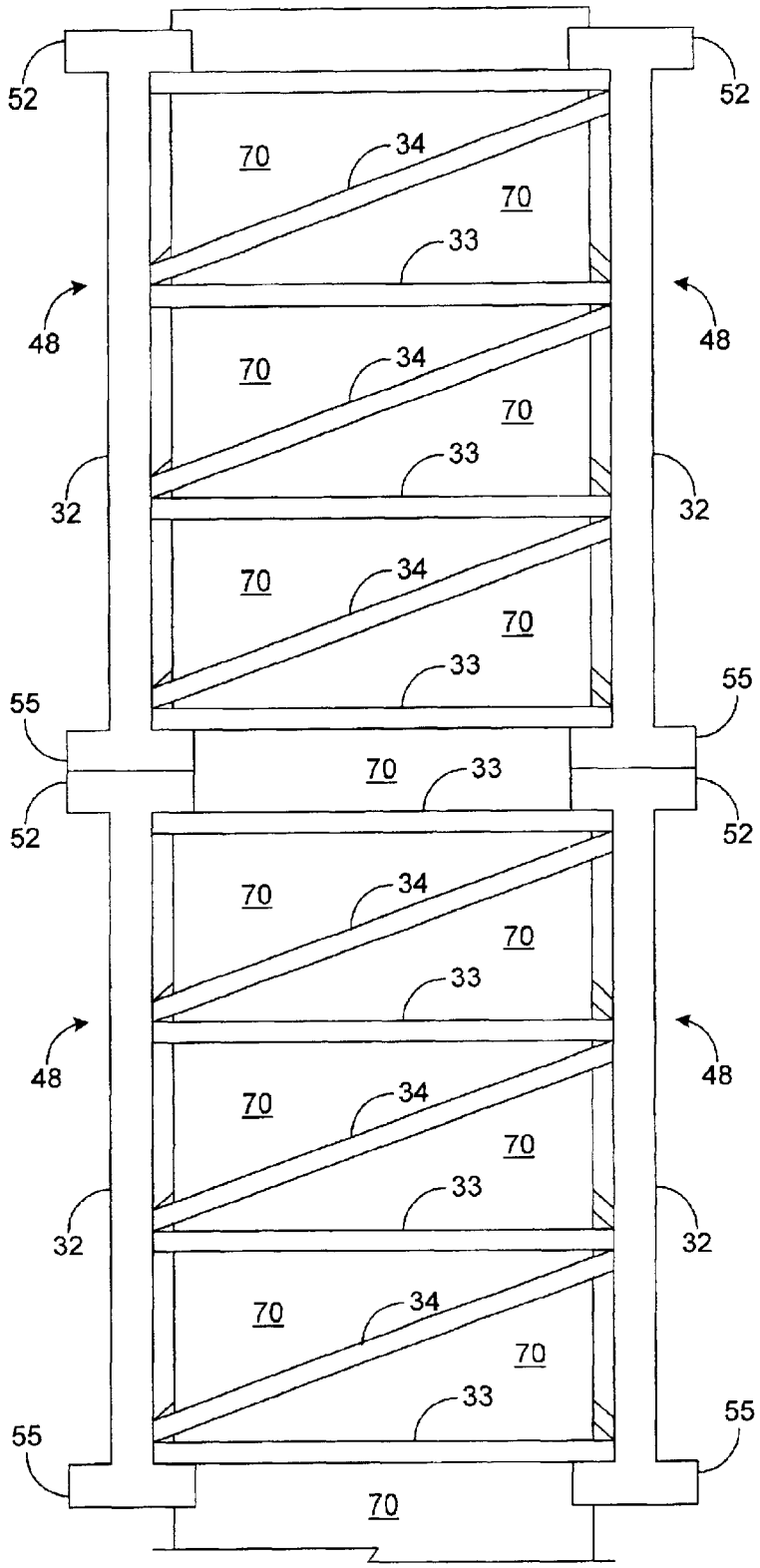
FIG. 15 is a diagram illustrating a more detailed view of the top two sections of the guyed tower depicted in FIG. 12.

The pole tower 70 may be in contact with the guyed tower 25 at various points along the vertical length of guyed tower 25. However, in the preferred embodiment, the diameter of the pole tower 70 is small enough such that the tower 70 can fit within the middle region of the guyed tower 25 without contacting the guyed tower 25, as shown by FIGS. 12, 14, and 15. However, the diameter of the pole tower 70 is preferably large enough such that the beams 32, 33, and/or 34 of the guyed tower 25 engage the pole tower 70 as the guyed tower 25 sways due to environmental forces, such as wind, for example. Thus, the guyed tower 25 is provided the flexibility of swaying to a small degree before engaging the pole tower 70. However, once the guyed tower 25 sways to the point that the guyed tower 25 engages the pole tower 70, the pole tower 70 helps to resist further swaying and thereby provides the guyed tower 25 with increased stability and support. Therefore, the diameter of the pole tower 70 should be based on how much sway is desired before the guyed tower 25 engages the pole tower 70. The amount of desirable sway should be based on many factors, such as the height and material of the guyed tower 25 and how much support from the tower 70 is needed to enable the guyed tower 25 to support a desired load. For many conventional guyed towers 25, it would be desirable for the pole tower 70 to be about one-quarter of an inch from the closest points of the guyed tower 25. However, other separation distances are possible in other embodiments.

The pole tower 70 may be erected as the guyed tower 25 is being erected. For example, the bottom section 45 of the guyed tower 25 may be fixedly attached to the foundation 28. Then, the bottom section 72 of the pole tower 70 may be erected within the bottom section 45 of the guyed tower 25 and fixedly attached to the foundation 28. Then, after each of the sections 46–48 of the guyed tower 25 is erected, one or more sections 73–76 of the pole tower 70 may be erected until the towers 25 and 70 shown by FIG. 12 are completely constructed.

For previously erected guyed towers 25, the pole tower 70 may be erected by lifting each section 72–76 of the pole tower 70 to the top of the guyed tower 25 and then lowering each section 72–76, one at a time, from the top of the guyed tower 25 through the middle region 58 of the guyed tower 25. For example, the tower 70 of FIG. 7 can be erected by first lifting the bottom section 72 to the top of the guyed tower 25 and then lowering the bottom section 72 through the middle of the guyed tower 25 until the section 72 contacts the foundation 28. The bottom section 72 may then be fixedly attached to foundation 28. Then, section 73 may be lifted to the top of the guyed tower 25 and lowered through the middle of the guyed tower 25 until section 73 contacts and is secured to section 72. Then, sections 74–76 may be consecutively lifted to the top of the guyed tower 25 and lowered through the middle of the guyed tower 25 until the pole tower 70 shown by FIG. 7 is erected within the guyed tower 25. Thus, even when the guyed tower 25 has been fully erected, the pole tower 70 may be erected through the guyed tower 25, as shown by FIG. 12.

As previously set forth, it is not necessary for the pole tower 70 to be fixedly attached to the guyed tower 25 in order for the pole tower 70 to stabilize and support the guyed tower 25. However, it is possible to fixedly attach the pole tower 70 to the guyed tower 25 at various points in order to increase the stability and support provided by the pole tower 70. Various techniques may be employed to attach the pole tower 70 to the guyed tower 25.

Figure 16:
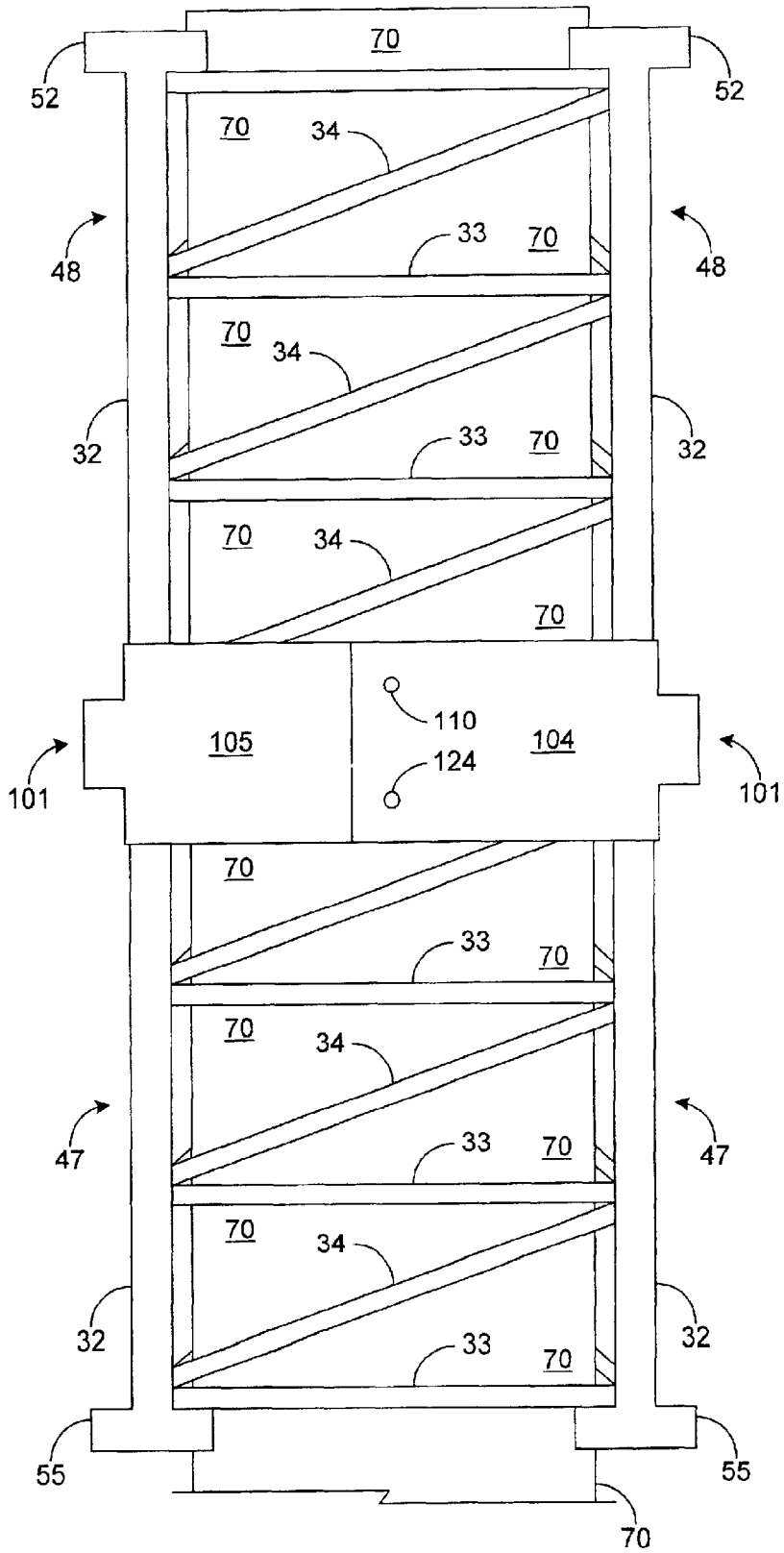
FIG. 16 is a diagram illustrating the top two guyed tower sections depicted in FIG. 15 when the guyed tower of FIG. 12 is fixedly attached to the pole tower of FIG. 12 at point where the top two guyed tower sections are interfaced.
Figure 17:
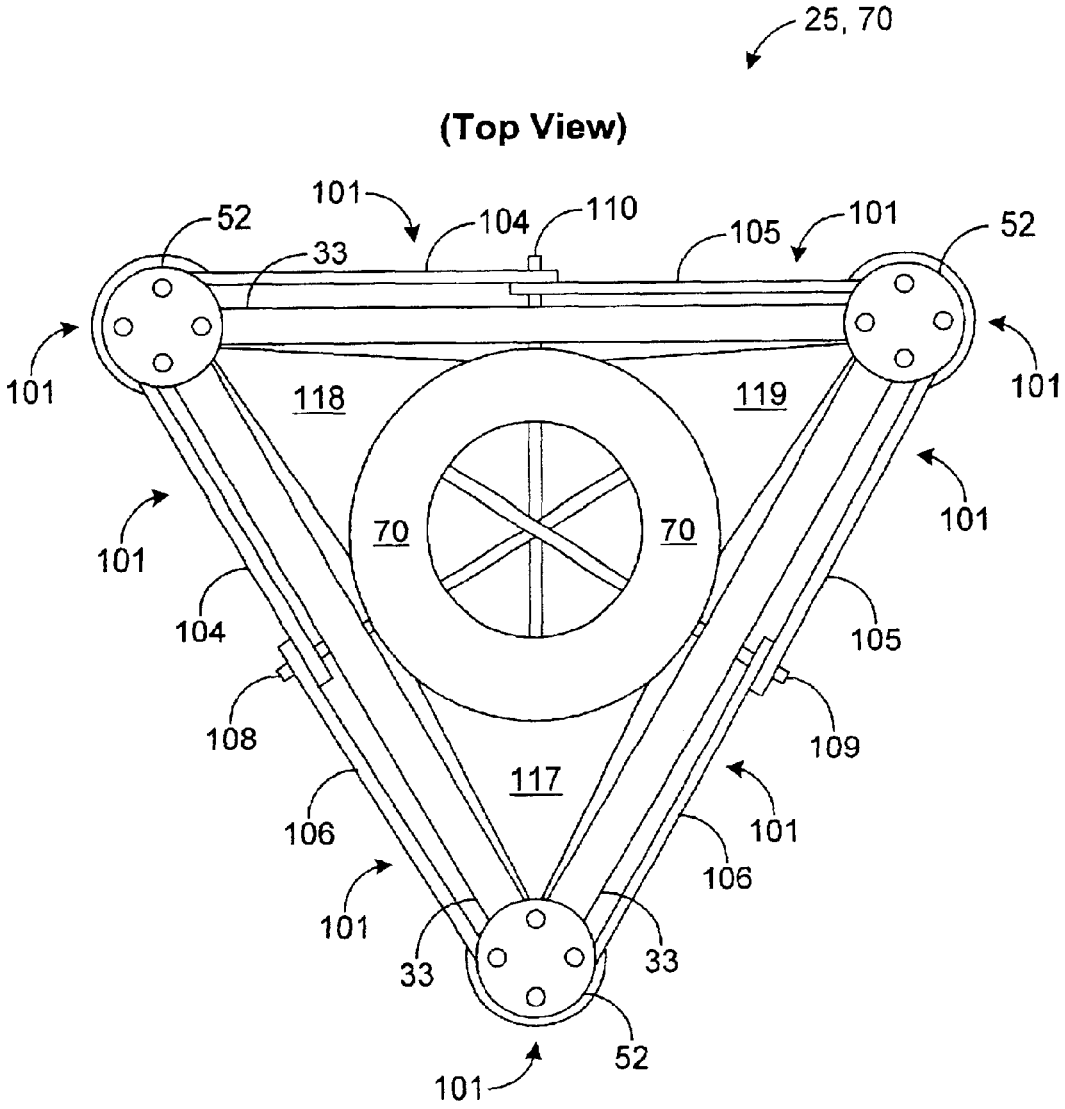
FIG. 17 is a diagram illustrating a top view of the guyed tower and the pole tower depicted in FIG. 16.
Figure 18:
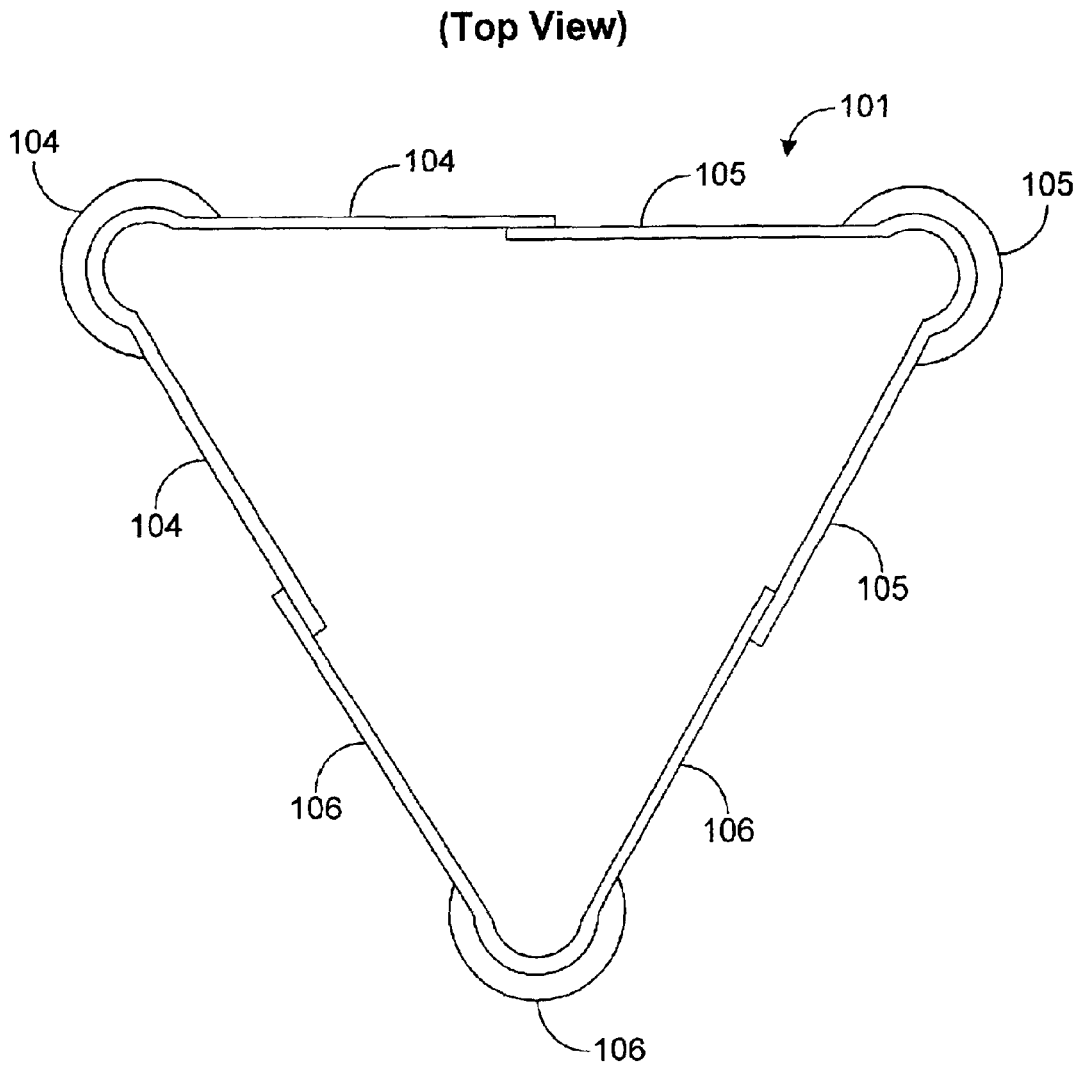
FIG. 18 is a diagram illustrating a top view of a collar depicted in FIG. 17.

As an example, FIGS. 16–18 show an embodiment where a collar 101 is utilized to attach the pole tower 70 to the guyed tower 25. More specifically, FIG. 16 depicts a detailed view of the guyed tower sections 47 and 48 of FIG. 6 once the pole tower 70 has been erected through the guyed tower 25 and, therefore, through the sections 47 and 48. In FIG. 16, the collar 101 is positioned at the interface between sections 47 and 48. As shown by FIGS. 17 and 18, the collar 101 is comprised of three members 104–106, which are secured to one another by couplers 108–110. In this regard, each coupler 108–110 passes through at least two of the members 104–106 and the tower 70, thereby securing the members 104–106 to the tower 70. The couplers 108–110 may be bolts, screws, nails, or other fastening devices that can fixedly attach the collar 101 to the pole tower 70. Any device capable of securing the collar 101 to the pole tower 70 should be suitable for implementing the present invention.

To enable the couplers 108–110 to better secure the collar 101 to the towers 25 and 70, a nut (not shown) may be fastened at each end of each coupler 108–110. Alternatively, the holes in the collar 101 and/or tower 70 through which the couplers 108–110 pass may be threaded. Any conventional technique for securing a coupler to another structure may be employed to secure the couplers 108–110 to the collar 101 and/or the tower 70.

In the preferred embodiment, each coupler 108–110 may be driven into a spacer 117–119, respectively, as shown by FIG. 17. Each spacer 117–119 is a small wedge placed between the pole tower 70 and the guyed tower 25 at a location such that the spacers 117–119 respectively receive the couplers 108–110 as they are driven through the tower 70, as shown by FIG. 17. One side of each spacer 117–119 is adapted to fit against a vertical beam 32, and an opposite end of each spacer 117–119 is adapted to fit against the pole tower 70. Since the spacers 117–119 are wedged between the towers 25 and 70, penetration of each coupler 108–110 into its respective spacer 117–119 helps to maintain the position of each coupler 108–110 to its respective spacer 117–119 and, therefore, to the towers 25 and 70. Thus, the spacers 117–119 and couplers 108–110 help to secure the collar 101 to the towers 25 and 70.

The collar 101 should be shaped such that the collar 101 fits around the guyed tower 25 and such that the inner portion (i.e., the portion facing the guyed tower 25) is in contact with the guyed tower 25 when the couplers 108–110 are secured to the collar 101 and the tower 70 as shown by FIG. 17. In the configuration shown by FIG. 17, the couplers 108–110 should resist movement by the collar 101 with respect to the tower 70. Therefore, the collar 101, which is positioned against the guyed tower 25, should resist movement by the guyed tower 25 with respect to the pole tower 70. As a result, the collar and coupler arrangement shown by FIGS. 16–18 should transfer at least some of the stresses or bending moments from the guyed tower 25 to the pole tower 70. It should be noted that the arrangement shown by FIGS. 16–18 is exemplary, and other techniques and devices may be used to attach the pole tower 70 to the guyed tower 25 in other embodiments.

Figure 19:
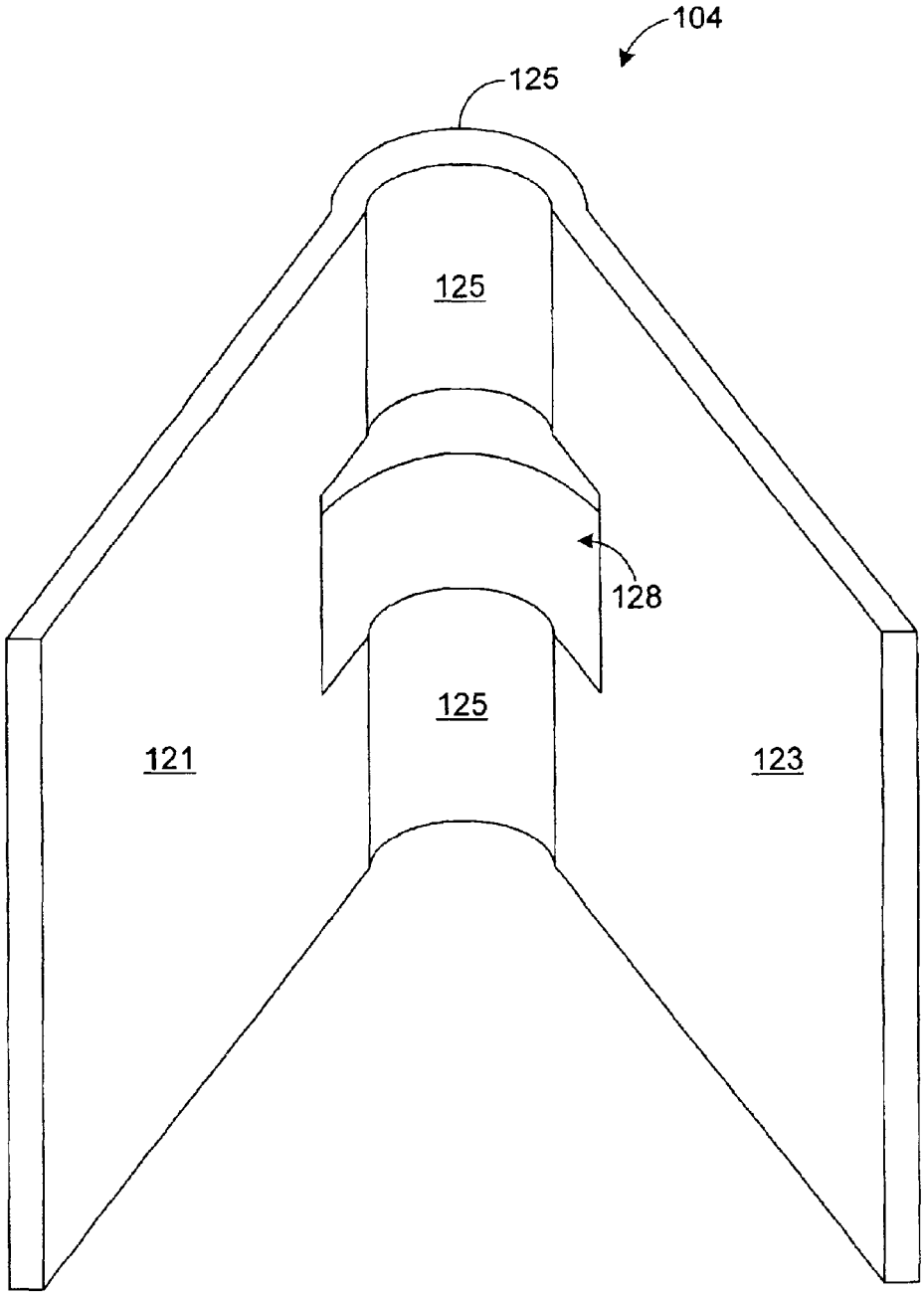
FIG. 19 is a diagram illustrating a three-dimensional front view of one of the members forming the collar depicted in FIG. 18.
Figure 20:
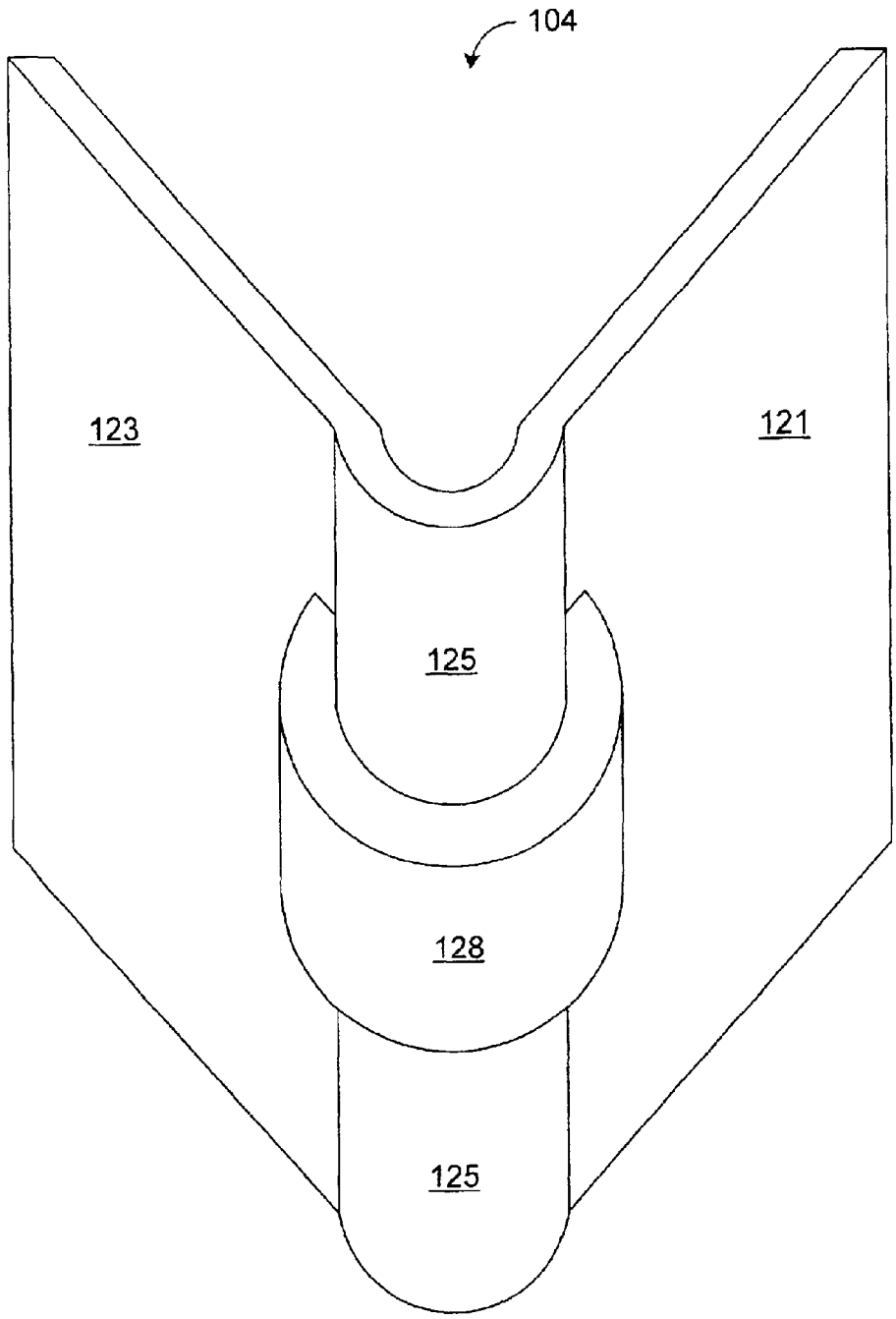
FIG. 20 is a diagram illustrating a three-dimensional back view of the one member depicted in FIG. 19.

FIGS. 19 and 20 depict three-dimensional views of one of the members 104 that comprises the collar 101. Note that each of the members 104–106 may be identically configured. The member 104 shown by FIGS. 19 and 20 includes two flat panels 121 and 123 that extend from a tubular portion 125. The tubular portion 125 is adapted to receive one of the vertical beams 32 of the guyed tower 25 such that the inner portion of the tubular portion 125 contacts the outer portion of the vertical beam 32 as shown by FIGS. 16 and 17.

Furthermore, the tubular portion 125 includes an enlarged section 128 adapted to house portions of a joined set of flanges 52 and 55 of the guyed tower 25 when the member 104 is attached to an interface between any of the sections 45–48 of the guyed tower 25, as shown by FIGS. 16 and 17. In this regard, when the member 104 is secured to the guyed tower 25 as shown by FIGS. 16 and 17, the tubular portion 125 preferably engages a vertical beam 32 of each of the sections 47 and 48, and the flanges 52 and 55 of these beams 32 preferably fit within the enlarged section 128.

For example, in FIG. 16, the member 104 is secured to the tower 25 at the interface of sections 47 and 48. As shown by FIG. 16, the member 104 (more specifically, the tubular portion 125 of the member 104) is engaged with a vertical beam 32 of section 47 and with a vertical beam 32 of section 48. The lower flange 55 of the foregoing beam 32 from section 48 is joined to the upper flange 52 of the foregoing beam 32 from section 47. A portion of these flanges 52 and 55 fit within and are housed by the enlarged section 128 of member 104, and as shown by FIG. 17, the flat panels 121 and 123 of the member 104 each extend in a direction substantially parallel to the horizontal beams 33 that are connected to the aforementioned vertical beams 32. As a result, the members 104–106 should engage and fit around the guyed tower 25, as shown by FIGS. 16 and 17.

Figure 21:
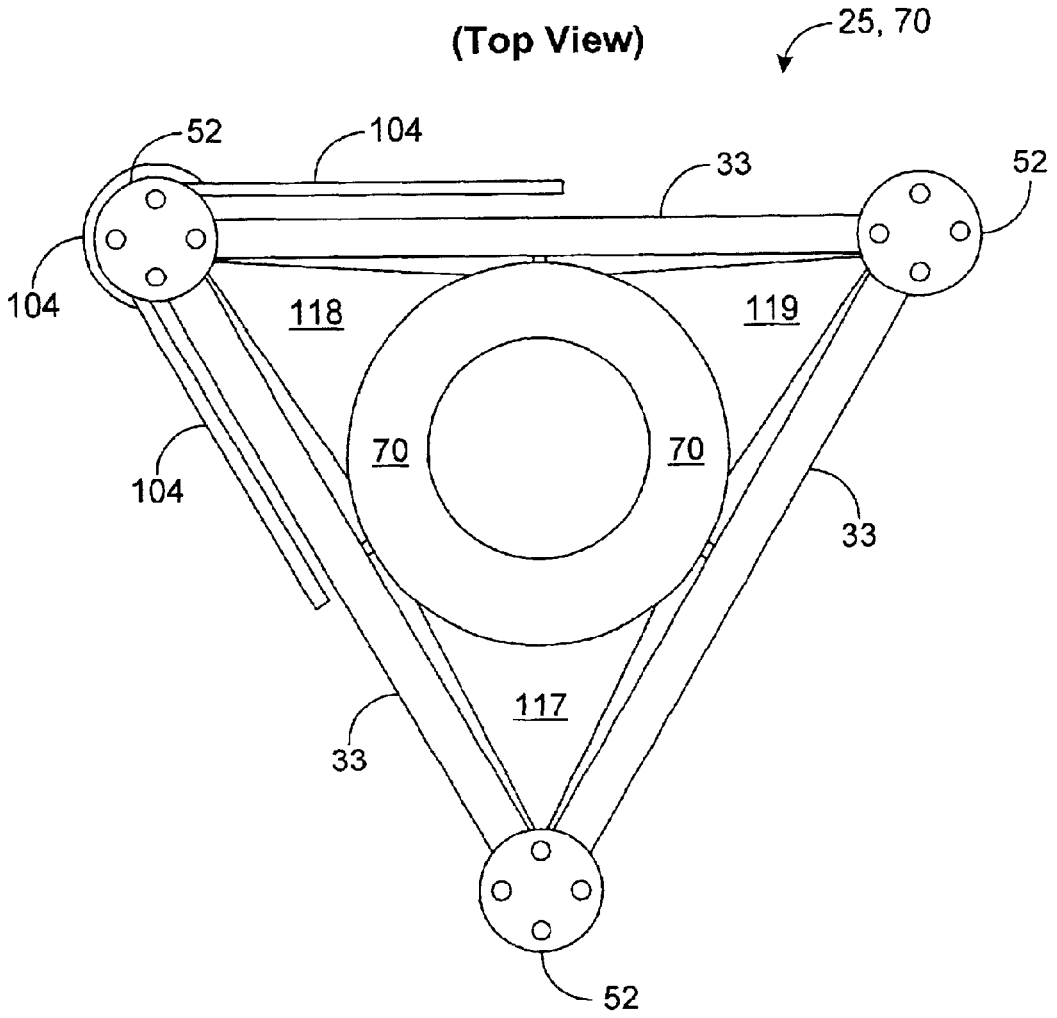
FIG. 21 is a diagram illustrating the guyed tower and the pole tower of FIG. 17 when only one collar member has been positioned against the guyed tower.
Figure 22:
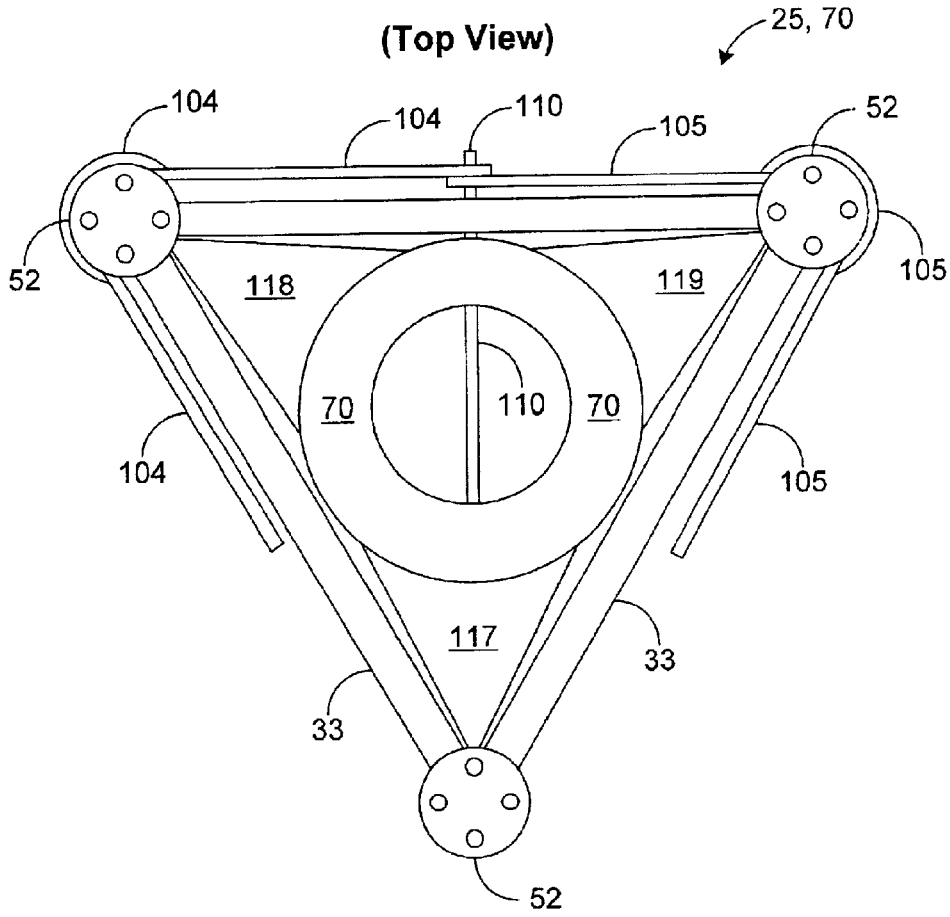
FIG. 22 is a diagram illustrating the guyed tower and the pole tower of FIG. 17 when a second collar member has been positioned against the guyed tower.

To secure the collar 101 to the pole tower 70 and to the guyed tower 25 according to FIGS. 16 and 17, the member 104 is first positioned against the guyed tower 25, as shown by FIG. 21. After engaging the member 104 with the guyed tower 25, the member 105 may be similarly positioned against the guyed tower 25, such that the member 105 engages a different set of vertical beams 32 of sections 47 and 48, as shown by FIG. 22. Preferably, one of the flat panels 121 or 123 of member 105 overlaps one of the flat panels 121 or 123 of member 104 as shown by FIG. 22. The coupler 110 is then passed through the overlapping sections of members 104 and 105. This coupler 110 is also passed through tower 70 and into spacer 117. To better secure the collar 101 to the towers 25 and 70, it is desirable to pass at least one additional coupler 124 (FIG. 16) through the overlapping sections of members 104 and 105, tower 70, and spacer 117. This additional coupler 124 may be located directly beneath the coupler 110 as shown in FIG. 16. Note that the additional coupler 124 is not a necessary feature and, when employed, does not necessarily have to positioned directly beneath the coupler 110.

Once the members 104 and 105 have been secured as shown by FIG. 22, the third member 106 may be positioned against the guyed tower 25, such that the member 106 engages the remaining set of vertical beams 32 of sections 47 and 48, as shown by FIG. 17. When the third member 106 is placed in this position, a portion of the flat panel 121 or 123 of the member 105 should overlap with a portion of the flat panel 121 or 123 of member 106, and a portion of the flat panel 121 or 123 of member 106 should overlap with a portion of the flat panel 121 or 123 of member 104. The coupler 109 is passed through the overlapping portions of members 105 and 106, tower 70, and spacer 118 as shown by FIG. 17. Furthermore, the coupler 108 is passed through the overlapping portions of members 104 and 106, tower 70, and spacer 119 as shown by FIG. 17.

To better secure the collar 101 to the towers 25 and 70, additional couplers (not shown) may be passed through the overlapping portions of members 105 and 106, the tower 70, and the spacer 118 and through the overlapping portions of members 104 and 106, the tower 70, and the spacer 119. Once each of the members 104–106 and each of the couplers 108–110 have been positioned as shown in FIG. 17, the collar 101 should be adequately secured to the guyed tower 25 and the tower 70. Thus, stress experienced by the guyed tower 25 may be passed from the guyed tower 25 to the tower 70 via the collar 101 and the couplers 108–110. As a result, the pole tower 70 provides better support to the guyed tower 25 at the point where the collar 101 is engaged with the guyed tower 25.

Each collar 101 secured to the guyed tower 25 and pole tower 70 as previously described should enable the tower 70 to provide better support and stability to the guyed tower 25. To maximize the support and stability provided by the pole tower 70 to the guyed tower 25, it is desirable to select the location of each collar 101 based on the design of the guyed tower 25. In this regard, it is desirable to place each collar 101 at the point on guyed tower 25 needing the most reinforcement. Normally, the weakest points of the guyed tower 25 are located at the point of interface between different sections 45–48 (i.e., at the joined flanges 52 and 55 between any two sections 45–48 that are secured to one another) and at the midpoint of each section 45–48.

Figure 23:
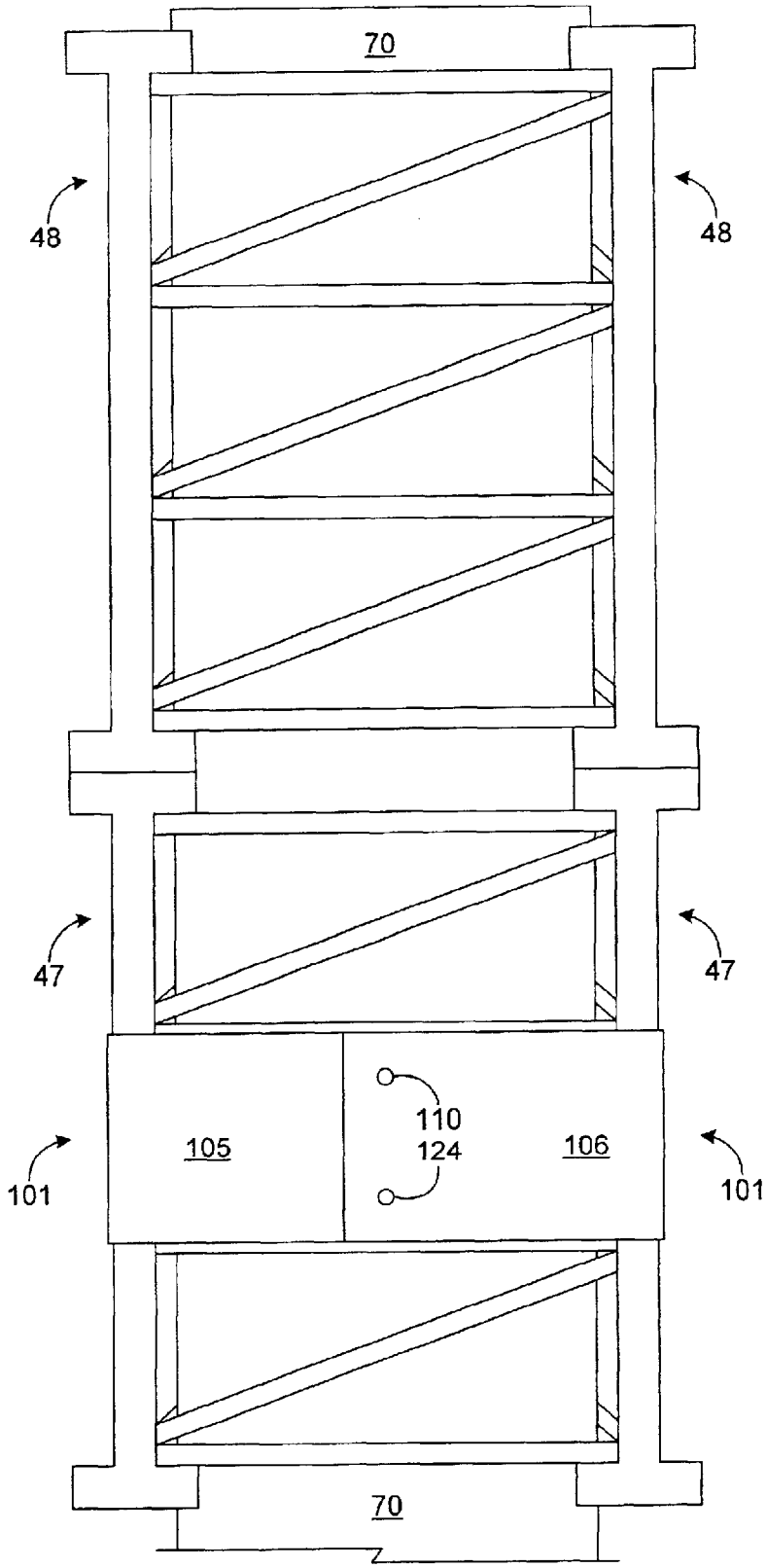
FIG. 23 is a diagram illustrating the top two guyed tower sections depicted in FIG. 15 when the guyed tower of FIG. 12 is fixedly attached to the pole tower of FIG. 12 at a midpoint of one of the guyed tower sections.
Figure 24:
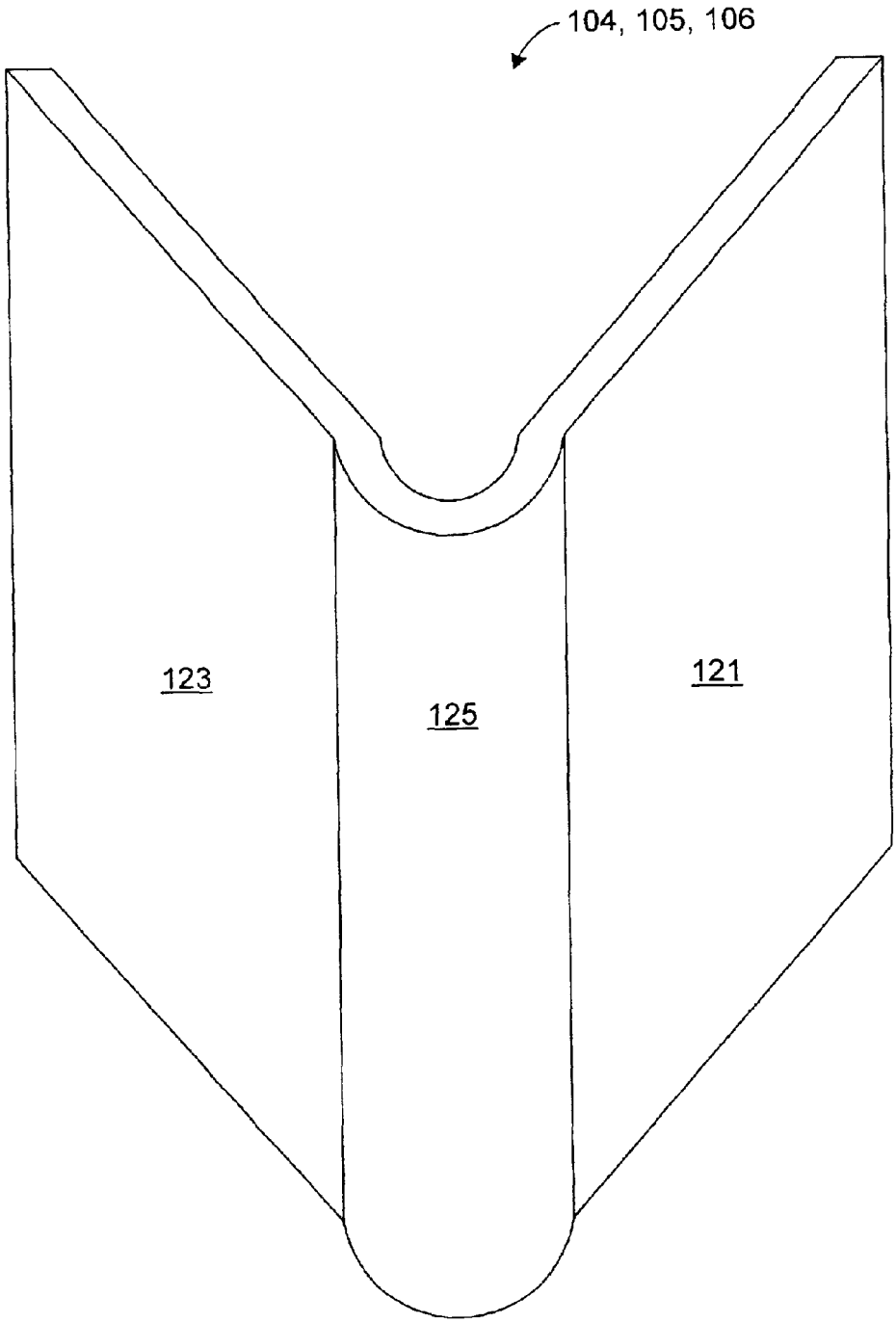
FIG. 24 is a diagram illustrating a three-dimensional back view of a collar member that may be used to fixedly attach the pole tower to the guyed tower at a midpoint of a guyed tower section.

FIG. 16 shows a collar 101 attached to sections 47 and 48 at one of these weak points. In particular, the collar 101 is attached to the guyed tower 25 at the interface between sections 47 and 48. Other weak points of the sections 47 and 48 exist at the midpoint of section 47 and at the midpoint of section 48. FIG. 23 shows a collar 101 secured to the section 47 at the midpoint of section 47. In this embodiment, the collar 101 does not house any flanges 52 or 55, and as shown by FIGS. 23 and 24, there is no need for the collar of FIG. 23 to include an enlarged section 128 (FIGS. 19 and 20). However, if desired, a collar 101 having an enlarged section 128 may be used to secure the pole tower 70 to the guyed tower 25 at a midpoint of a guyed tower section 45–48, since adequate contact between the guyed tower 25 and the members 104–106 of the collar 101 should be provided by the tubular portions 125 (FIGS. 19 and 20) of the members 104–106. Moreover, the methodology for attaching the collar 101 at a midpoint of the section 47 should be the same as the methodology for attaching the collar 101 at the point of interface between sections 47 and 48, as previously described hereinabove.

Figure 25:
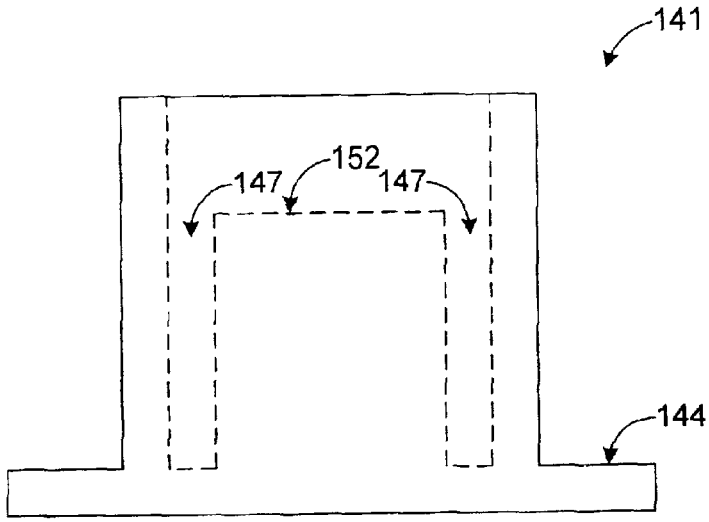
FIG. 25 is a diagram illustrating a side view of a base that may be used to attach a non-tapered bottom section of a pole tower to a foundation.
Figure 26:
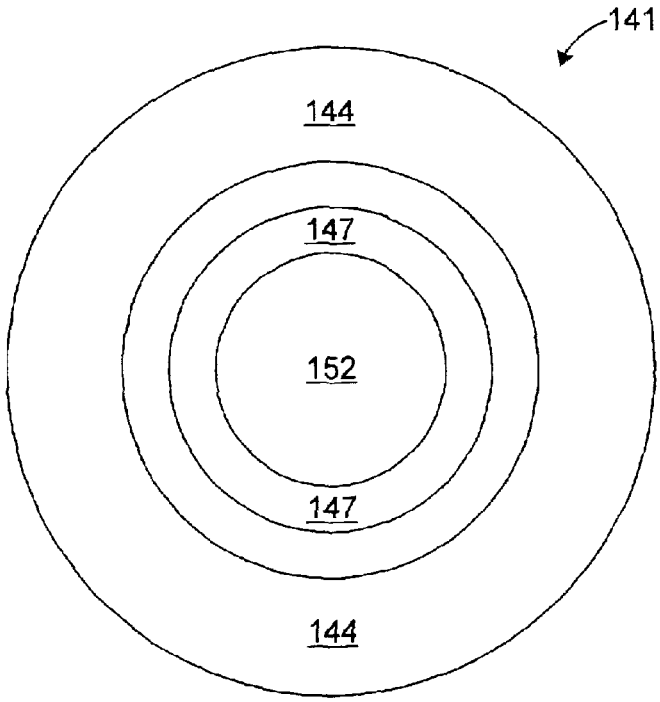
FIG. 26 is a diagram illustrating a top view of the base depicted in FIG. 25.
Figure 27:
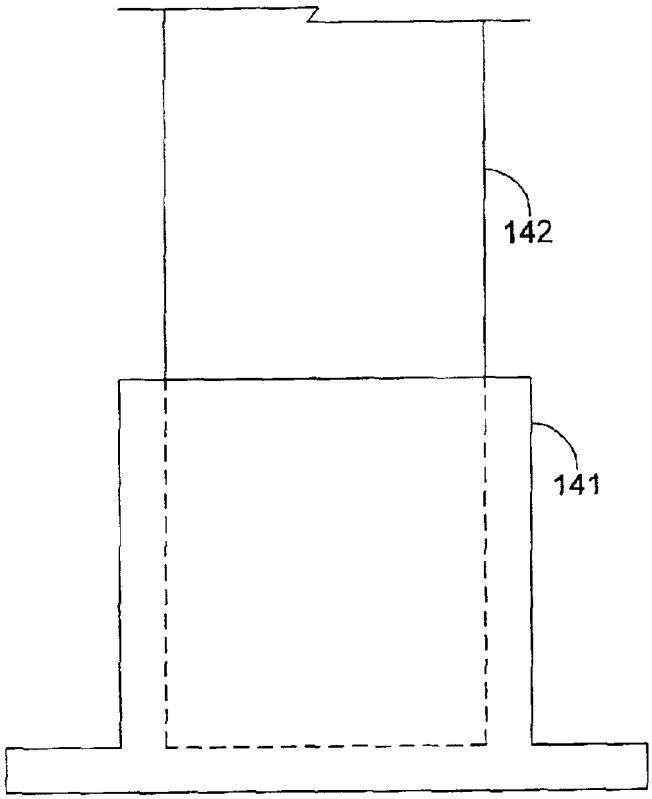
FIG. 27 is a diagram illustrating a non-tapered bottom section of a pole tower positioned within the base depicted in FIG. 25.

It should be noted that the weight of the tower 70 is applied along the surface of the bottom section 72 that is in contact with the foundation 28. Thus, depending on the size and material of the tower 70, there may be some buckling concerns associated with the bottom section 72, particularly when the section 72 is not tapered. To provide the bottom section of the pole tower 70 with better support for preventing buckling, the bottom section may be coupled to the foundation 28 through a base 141, such as the one shown by FIGS. 25 and 26. Note that the base 141 shown by FIG. 25 is designed to be engaged with an untapered bottom section of the pole tower, unlike the tapered bottom section 72 shown by FIG. 7. As shown by FIGS. 25 and 26, the bottom of the base 141 forms a flange 144 that may be bolted or otherwise coupled to the foundation 28. The base 141 also includes a hollow region 147 in which an untapered bottom section 142 of tower 70 may be inserted, as shown by FIG. 27. A core section 152 of the base 141 may fit into a hollow region of the bottom section 142. By configuring the base 141 as shown by FIGS. 25–27, the base 141 should absorb at least some of the buckling stresses applied to the bottom section 142.

When the tower 70 includes a tapered bottom section 72, as shown by FIG. 7, the weight of the tower 70 acts as a point load through the bottom section 72, and buckling of the bottom section 72, therefore, should not be as great of a concern. Thus, a base 141, similar to the one shown by FIGS. 25–27, may not be necessary when the bottom section 72 is tapered.

Figure 28:
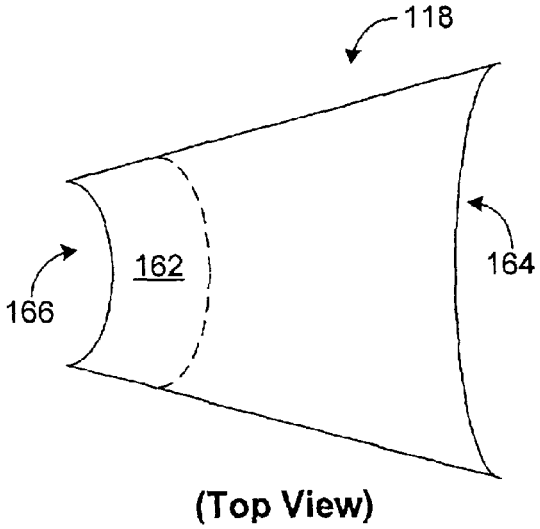
FIG. 28 is a diagram illustrating a top view of a spacer that may be used to fixedly attach the pole tower of FIG. 7 to the guyed tower of FIG. 1.
Figure 29:
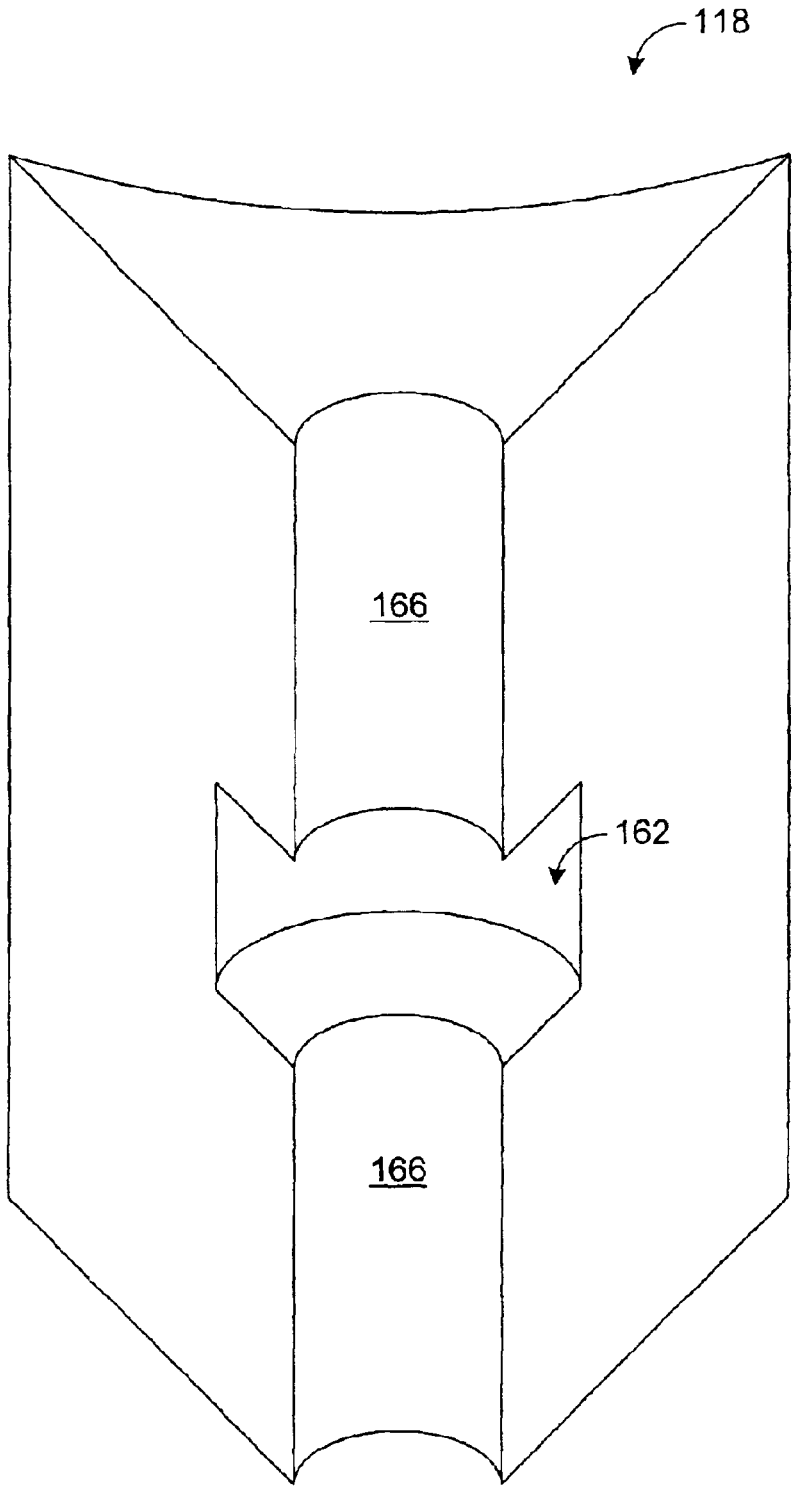
FIG. 29 is diagram illustrating a three-dimensional view of the spacer depicted in FIG. 28.

In addition, the spacers 117–119 may enable the tower 70 to provide better support to the guyed tower 25, if the spacers 117–119 are configured to directly support the flanges 52 and 55 of the guyed tower 25. FIGS. 28 and 29 depict a configuration for one of the spacers 118 that enables the spacer 118 to provide support directly to a set of flanges 52 and 55. In this regard, the spacer 118 includes a hollow region 162 that is adapted to receive a set of flanges 52 and 55.

For example, assume that the spacer 118 is utilized to fixedly attach the tower 70 to sections 47 and 48 of the guyed tower 25, as shown by FIGS. 16 and 17. In this embodiment, one side 164 of the spacer 118 should be engaged with the tower 70, and the opposite side 166 of the spacer 118 should be engaged with a vertical beam 32 of section 47 and with a vertical beam 32 of section 48. The foregoing beams 32 of sections 47 and 48 should respectively include an upper flange 52 and a lower flange 55 that are fixedly attached or, in other words, joined to one another. This set of flanges 52 and 55 should reside within the hollow region 162 of spacer 118 such that spacer 118 houses a portion of the set of flanges 52 and 55. Thus, a portion of the set of flanges 52 and 55 on one side of the guyed tower 25 should be housed by the enlarged section 128 of member 104, and another portion of the set of flanges 52 and 55 on the opposite side of the guyed tower 25 should be housed by spacer 118.

Figure 30:
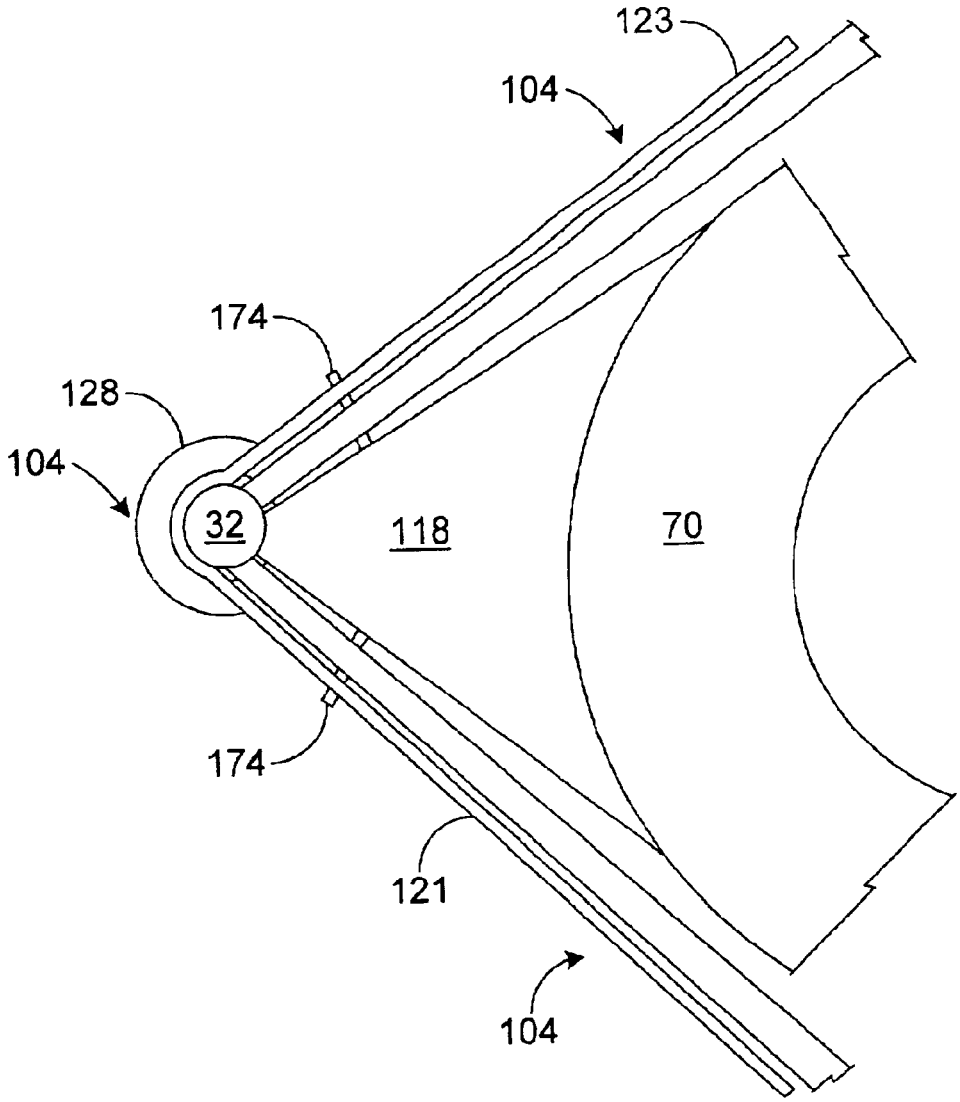
FIG. 30 is a top view illustrating the spacer of FIG. 28 when the spacer is wedged between a vertical beam of the pole tower of FIG. 7 and the guyed tower of FIG. 1. The top flange of the vertical beam has been removed from FIG. 30 in order to better illustrate the configuration of the spacer.

Preferably, the enlarged section 128 of member 104 and the hollow region 162 of spacer 118 are configured such that the set of flanges 52 and 55 barely fits into the enlarged section 128 and hollow region 162. Indeed, the inner walls of enlarged section 128 and the inner walls that define hollow region 162 preferably engage the set of flanges 52 and 55 when the set of flanges 52 and 55 are residing in member 104 and spacer 118. As shown by FIG. 30, one or more couplers 174 may be drilled into the spacer 118 through the member 104 to more tightly hold the spacer 118 and the member 104 against the set of flanges 52 and 55. By housing the set of flanges 52 and 55 with the member 104 and spacer 118, as described hereinabove, the pole tower 70 is able to provide better support to the guyed tower 25, particularly at the point of interface between two joined sections 47 and 48.

In addition, the other spacers 117 and 119 and the other members 105 and 106 may be configured similar to the spacer 118 and member 104 shown by FIG. 30. However, it should be noted that it is not necessary for any of the spacers 117–119 to house any of the joined sets of flanges 52 and 55. Indeed, it is not even necessary for the guyed tower 25 to be fixedly attached to the pole tower 70. Furthermore, when spacers 117–119 are used to fixedly attach the pole tower 70 to the guyed tower 25, each of the spacers 117–119 may be coupled to a single vertical beam 32 such that no sets of flanges 52 and 55 reside within hollow region 162. Thus, in some embodiments, hollow region 162 is not a necessary feature of the spacers 117–119.

It should be further noted that FIG. 17 shows the pole tower 70 as having a circular cross-section. However, it is not necessary for the pole tower 70 to have a circular cross-section, and other cross-sectional shapes for the pole tower 70 are possible without departing from the principles of the present invention.

In addition, the present invention has been described as providing support to a guyed tower 25 that has three vertical beams 32 in each section 46–48 of the guyed tower 25. However, as previously set forth, other numbers of vertical beams 32 and other configurations may be employed to implement the guyed tower 25. In such embodiments, the pole tower 70 may be fixedly attached to the guyed tower via a collar, similar to collar 101, that is adapted to extend around the perimeter of the guyed tower. Moreover, spacers and couplers, similar to the spacers 117–119 and couplers 108–110 previously described, may be used to fixedly attach the pole tower 70 to the guyed tower 25 in these other embodiments.

By erecting a pole tower 70 within the guyed tower 25 as described hereinabove, bending moments experienced by the guyed tower 25 may be passed into and absorbed by the pole tower 70, thereby increasing the stability of the guyed tower 25. The strength and stability provided by the pole tower 70 to the guyed tower 25 may be maximized by fixedly attaching the pole tower 70 to the guyed tower 25 at one or more points along the length of the guyed tower 25. As a result, the guyed tower 25 should be able to support additional loads once the pole tower 70 has been erected according to the techniques described herein.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed is:

1. A system for supporting wireless communication equipment, comprising:

a foundation;

a guyed tower fixedly attached to said foundation; and a pole tower fixedly attached to said foundation and extending through a middle region of said guyed tower, wherein said guyed tower has a top section, a bottom section, and at least one middle section between said top and bottom sections, each of said sections respectively having a plurality of beams and at least three substantially parallel beams, each of the plurality of beams coupled to the substantially parallel beams, wherein said bottom section is secured to said foundation, wherein each of the substantially parallel beams for each of said respective sections is fixedly attached to the substantially parallel beams of an adjacent guyed tower section, and wherein a periphery of the plurality of beams for said bottom section does not exceed a periphery of the plurality of beams for said top section.

2. The system of claim 1, wherein said pole tower is separated from an inner periphery of said guyed tower by about one-quarter of an inch.

3. The system of claim 1, further comprising communication equipment attached to said pole tower.

4. The system of claim 1, wherein said guyed tower is comprised of at least two joined guyed tower sections, and wherein said pole tow is fixedly attached to said guyed tower at a midpoint of one of said joined guyed tower sections.

5. The system of claim 1, wherein said guyed tower is comprised of at least two joined guyed tower sections, and wherein said pole tower is fixedly attached to said guyed tower at an interface between said joined guyed tower sections.

6. The system of claim 1, wherein said pole tower has a bottom end and a top end opposite of said bottom end, said bottom end fixedly attached to said foundation, and wherein said pole tower extends from said foundation to said top section of said guyed tower.

7. The system of claim 6, wherein said top end of said pole tower extends through said top section of said guyed tower, said top end of said pole tower having communication equipment mounted thereto at a point above said top section of said guyed tower.

8. The system of claim 1, wherein said single pole tower provides substantial support to said guyed tower.

9. A method for increasing a load capacity of an erected guyed tower, comprising the steps of:

erecting a pole tower within an inner region of said guyed tower; and attaching said pole tower to a foundation, wherein said guyed tower has a bottom section, a top section, and at least one middle section between said bottom section and said top section, wherein said pole tower as a plurality of sections, and wherein said erecting step further comprises the steps of:

lifting each of said pole tower sections to said top section of said erected guyed tower; and passing each of said pole tower sections through said top section of said erected guyed tower.

10. The method of claim 9, wherein said attaching step comprises the step of fixedly attaching one of said pole tower sections to said foundation.

11. The method of claim 9, wherein at least one other pole tower section extends above said top section subsequent to said erecting step.

12. A method for increasing a load capacity of a previously erected guyed tower, said previously erected guyed tower having a bottom section a top section, and at least one middle section between said bottom section and said top section, comprising the steps of:

passing each of a plurality of sections of said pole tower through said top section of said previously erected guyed tower and into an inner region of said previously erected guyed tower; and attaching each of said sections of said pole tower to at least one other respective section of said pole tower within said previously erected guyed tower thereby forming at least a portion of said pole tower within said previously erected guyed tower.

13. The method of claim 12, further comprising step of attaching one of said sections of said pole tower to a foundation.

14. The method of claim 13, wherein said previously erected guyed tower is attached to said foundation.

15. The method of claim 12, further comprising the step of attaching a section of said pole tower to one of said plurality of sections of said pole tower such that a portion of said pole tower extends above said previously erected guyed tower.

* * * * *